US009481186B2

(12) United States Patent
Bouverie et al.

(10) Patent No.: US 9,481,186 B2
(45) Date of Patent: Nov. 1, 2016

(54) AUTOMATICALLY ADJUSTING PRINTING PARAMETERS USING MEDIA IDENTIFICATION

(75) Inventors: William M. Bouverie, Windermere, FL (US); Mark Allen Hitz, Rock Hill, SC (US); Richard Hatle, Oviedo, FL (US); Marjorie Hitz, legal representative, Rock Hill, SC (US)

(73) Assignee: Datamax-O'Neil Corporation, Orlando, FL (US)

( * ) Notice: Subject to any disclaimer, the term of this patent is extended or adjusted under 35 U.S.C. 154(b) by 28 days.

(21) Appl. No.: 13/548,882

(22) Filed: Jul. 13, 2012

(65) Prior Publication Data

US 2013/0016368 A1 Jan. 17, 2013

Related U.S. Application Data

(60) Provisional application No. 61/507,715, filed on Jul. 14, 2011.

(51) Int. Cl.

| | |
|---|---|
| ***B41J 11/00*** | (2006.01) |
| ***B41J 35/36*** | (2006.01) |
| ***B41J 17/36*** | (2006.01) |

(52) U.S. Cl.

CPC ..... *B41J 11/009* (2013.01); *B41J 17/36* (2013.01); *B41J 35/36* (2013.01)

(58) Field of Classification Search

CPC ..... B41J 11/009
USPC ..... 399/13, 24
See application file for complete search history.

(56) References Cited

U.S. PATENT DOCUMENTS

| | | | |
|---|---|---|---|
| 4,143,977 | A | 3/1979 | Kurihara et al. |
| 4,177,731 | A | 12/1979 | Kleist et al. |

(Continued)

FOREIGN PATENT DOCUMENTS

| | | |
|---|---|---|
| EP | 0911699 A2 | 4/1999 |
| EP | 2927005 | 7/2015 |

(Continued)

OTHER PUBLICATIONS

Written Opinion of the International Searching Authority, PCT/US2012/036297, Jul. 17, 2012.

(Continued)

*Primary Examiner* — Eric A Rust
(74) *Attorney, Agent, or Firm* — Additon, Higgins & Pendleton, P.A.

(57) ABSTRACT

A method for automatically adjusting the setting(s) of a printer having a control circuit in communication with a sensory system and a database. The database is located in a storage medium and the data in the database includes one or more defined parameter settings corresponding to one or more media types. The sensory system is used to obtain a media identifier from media loaded into the printer. The control circuit determines the type of media from the media identifier. The media type is then compared to the database entries and used to retrieve any defined parameter setting(s) corresponding to the media type identified by the media identifier. Instructions to adjust the printer setting(s) according to the defined parameter setting(s) are determined at the control circuit. The control circuit then sends the instructions to the appropriate systems of the printer to adjusted the printer setting(s) according to the defined parameter setting(s).

15 Claims, 20 Drawing Sheets

(56) References Cited

U.S. PATENT DOCUMENTS 4,699,531 A 10/1987 Ulinski et al.
4,788,558 A 11/1988 Caldwell et al.
4,788,559 A 11/1988 Ende
4,872,659 A 10/1989 Kato et al.
4,924,240 A 5/1990 Herbert et al.
4,991,846 A 2/1991 Sondej
5,028,155 A 7/1991 Sugiura et al.
5,087,137 A 2/1992 Burnard et al.
5,206,662 A 4/1993 Fox et al.
5,326,182 A 7/1994 Hagstrom
5,397,192 A 3/1995 Khormaee
5,468,076 A 11/1995 Hirano et al.
5,488,223 A 1/1996 Austin et al.
5,490,638 A 2/1996 Driftmyer et al.
5,564,841 A * 10/1996 Austin ..... B41J 2/36 347/188
5,600,350 A 2/1997 Cobbs et al.
5,614,934 A 3/1997 Yoshida et al.
5,650,730 A 7/1997 Herbst, Jr.
5,684,516 A 11/1997 Cseledy et al.
5,790,162 A 8/1998 Adams et al.
5,820,280 A 10/1998 Fox
5,836,704 A 11/1998 Lau et al.
5,870,114 A 2/1999 Numata et al.
5,872,585 A 2/1999 Donato et al.
5,874,980 A 2/1999 West
5,909,233 A 6/1999 Hamman et al.
5,927,875 A 7/1999 Lau et al.
5,934,812 A * 8/1999 Nunokawa ..... B41J 3/4075 400/621
5,978,004 A 11/1999 Ehrhardt
5,995,128 A 11/1999 Adams et al.
6,014,229 A 1/2000 Yun
6,020,906 A 2/2000 Adams et al.
6,034,708 A 3/2000 Adams et al.
6,042,279 A 3/2000 Ackley
6,057,870 A 5/2000 Monnier et al.
6,070,048 A 5/2000 Nonaka et al.
6,082,914 A 7/2000 Barrus et al.
6,095,704 A 8/2000 Jaeger et al.
6,099,178 A 8/2000 Spurr et al.
6,129,463 A 10/2000 Lau et al.
6,201,255 B1 3/2001 Torchalski et al.
6,283,024 B1 9/2001 George
6,289,730 B1 9/2001 Elgee
6,302,604 B1 10/2001 Bryant et al.
6,389,241 B1 5/2002 Cernusak et al.
6,396,070 B1 5/2002 Christensen et al.
6,520,614 B2 2/2003 Kaneko
6,616,362 B2 9/2003 Bouverie et al.
6,825,864 B2 11/2004 Botten et al.
6,840,689 B2 1/2005 Barrus et al.
6,846,121 B2 1/2005 Bouverie et al.
6,857,714 B2 2/2005 Hohberger et al.
6,900,449 B2 5/2005 Bolash et al.
6,942,403 B2 9/2005 Hohberger et al.
7,042,478 B2 5/2006 Bouverie et al.
7,071,961 B2 7/2006 Ullenius et al.
7,079,168 B2 7/2006 Ullenius et al.
7,150,572 B2 12/2006 McNestry et al.
7,162,460 B2 1/2007 Cleckler et al.
7,205,561 B2 4/2007 Chelvayohan et al.
7,255,343 B2 8/2007 So
7,324,125 B2 1/2008 Gustafsson
7,375,832 B2 5/2008 Bouverie et al.
7,456,995 B2 11/2008 Stephens
7,502,042 B2 3/2009 Hitz et al.
7,537,404 B2 5/2009 Bouverie et al.
7,600,684 B2 10/2009 Tobin et al.
7,667,874 B2 2/2010 MacDonald et al.
7,699,550 B2 4/2010 Bouverie et al.
7,824,116 B2 11/2010 Lyman
7,845,632 B2 12/2010 Windsor et al.
7,857,414 B2 12/2010 Eun et al.
7,876,223 B2 1/2011 Yamaguchi et al.
7,891,892 B2 2/2011 Chiu
7,907,159 B2 3/2011 Matsuo et al.
7,934,881 B2 5/2011 Lodwig et al.
7,938,501 B2 5/2011 Takamiya et al.
8,142,087 B2 3/2012 Kugimachi
8,412,062 B2 4/2013 Kielland
8,456,710 B2 * 6/2013 Yamamoto ..... 358/3.26
2001/0008612 A1 7/2001 Liljestrand et al.
2003/0044189 A1 * 3/2003 Okitsu et al. ..... 399/45
2003/0053114 A1 3/2003 Hopper
2003/0072028 A1 4/2003 Haines et al.
2003/0081024 A1 5/2003 Vives et al.
2003/0132366 A1 7/2003 Gao et al.
2003/0141655 A1 7/2003 Bryer
2004/0008365 A1 1/2004 Hobbs
2004/0114024 A1 6/2004 Bouverie et al.
2004/0165927 A1 8/2004 Fisher et al.
2005/0002715 A1 1/2005 Fries et al.
2005/0189693 A1 9/2005 Ko
2005/0190368 A1 9/2005 Ehrhardt, Jr. et al.
2005/0204940 A1 9/2005 Elliott et al.
2006/0007295 A1 1/2006 Ueda
2006/0012666 A1 * 1/2006 Kim et al. ..... 347/221
2006/0045601 A1 3/2006 Endo
2006/0055721 A1 3/2006 Burdette et al.
2006/0157911 A1 7/2006 Learmonth et al.
2006/0159504 A1 7/2006 Blanchard, Jr. et al.
2006/0180737 A1 8/2006 Consiglio
2006/0182920 A1 8/2006 Craig
2007/0022233 A1 1/2007 Bridges et al.
2007/0040326 A1 2/2007 Noda et al.
2007/0059078 A1 3/2007 Silverbrook et al.
2007/0063429 A1 * 3/2007 Kang ..... 271/264
2007/0127965 A1 * 6/2007 Pagan et al. ..... 400/61
2007/0138738 A1 6/2007 Motohashi et al.
2008/0193190 A1 8/2008 Craig
2009/0038495 A1 2/2009 Butzen et al.
2009/0103806 A1 4/2009 Nakami
2009/0244584 A1 10/2009 McGarry et al.
2009/0261170 A1 10/2009 Craig
2010/0066782 A1 3/2010 Yamamoto et al.
2010/0068440 A1 3/2010 Craig
2010/0090394 A1 * 4/2010 You ..... 271/162
2010/0169513 A1 7/2010 Levin
2010/0247222 A1 9/2010 Bouverie et al.
2010/0319561 A1 12/2010 Colquitt et al.
2011/0042883 A1 2/2011 Wang et al.
2011/0132643 A1 6/2011 Hattori et al.
2013/0099142 A1 4/2013 Bouverie et al.
2015/0154892 A1 6/2015 Craig
2015/0273910 A1 10/2015 Colonel et al.

FOREIGN PATENT DOCUMENTS

JP 2000-141775 A 5/2000
JP 04552558 B2 9/2010
WO WO 95/24316 * 9/1995
WO 2004/114257 A2 12/2004
WO 2013010097 A1 1/2013

OTHER PUBLICATIONS

Written Opinion of the International Searching Authority, PCT/US2012/039043, Aug. 3, 2012.
Written Opinion of the International Searching Authority, PCT/US2012/041093, Aug. 7, 2012.
Written Opinion of the International Searching Authority, PCT/US2012/043734, Sep. 21, 2012.
Written Opinion of the International Searching Authority, PCT/US2012/043709, Sep. 21, 2012.
Written Opinion of the International Searching Authority, PCT/US2012/043772, Sep. 14, 2012.
Written Opinion of the International Searching Authority, PCT/US2012/046712, Oct. 5, 2012.
Written Opinion of the International Searching Authority, PCT/US2012/049417, Nov. 2, 2012.
Written Opinion of the International Searching Authority, PCT/US2012/050938, Nov. 6, 2012.

(56) References Cited

OTHER PUBLICATIONS

Written Opinion of the International Searching Authority, PCT/US2012/060956, Jan. 11, 2013.
Written Opinion of the International Searching Authority, PCT/US2012/066291, Feb. 5, 2013.
International Search Report No. PCT/US2012/46712 dated Oct. 5, 2012.
European Search Report for EP 12 81 0566 dated Mar. 5, 2015.
Search Report and Written Opinion in commonly owned European Application No. 15161521.8 dated Dec. 17, 2015, pp. 1-8.
Bosch Home Appliances, "Tassimo Manual for TAS451xUC and TAS 1000UC", Dated Jul. 24, 2009; Downloaded Feb. 9, 2015 from http://www.manualslib.com/download/355220/Bosch-Tas1000uc.html; 62 pages.

* cited by examiner

| Media Type | Description of type of media | Parameters | | | | | |
|---|---|---|---|---|---|---|---|
| | | print length (in) | print width (in) | Print Speed (IPS) | Print head pressure (1-10) | Ribbon Mode (0 - Coated in; 1 - Coated out; 2 - none) | Heat Balance (1-10) |
| 0001 | Continuous Label A | 2 | 3 | 6 | 8 | 1 | 5 |
| 0002 | Continuous Label B | 4 | 4 | 6 | 8 | 2 | 5 |
| 0003 | Fan Fold A | 8 | 8 | 7 | 5 | 2 | 8 |
| 0004 | Fan Fold B | 4 | 8 | 7 | 5 | 2 | 8 |
| 0005 | Roll fed | 20 | 4 | 8 | 5 | 1 | 4 |
| ... | | | | | | | |

*FIG. 24*

AUTOMATICALLY ADJUSTING PRINTING PARAMETERS USING MEDIA IDENTIFICATION

CROSS REFERENCE TO RELATED APPLICATIONS

This application is a non-provisional application, which claims priority from and the benefits of U.S. provisional application 61/507,715 filed on Jul. 14, 2011, the contents of which is incorporated herein by reference.

FIELD OF INVENTION

The present invention generally relates to printers; more specifically, to a method for automatically adjusting the setting(s) of a printer according to the type of print media and/or ribbon inserted into the printer.

BACKGROUND

Printers may accommodate one or more types of media, such as print media (e.g. stock paper, labels, etc.) or ribbon, of various sizes. Printer sensors are typically used in printers to determine the presence and location of the edge of the media during operation. Use of printer sensors may assist in determining whether an appropriate location is available in the print area or ribbon and that edge or over-the-edge printing does not occur. Further, use of printer sensors may assist in determining the position of a label within a printhead, that is, the distance that the media has advanced. Printer sensors may also be used to read a position indicating stripe on media. Thus, printer sensors may be utilized to recognize the presence and/or position of media of various sizes.

However, once the presence and/or position of the media is detected, a user must adjust the settings of the printer so as to correspond with the media in order to achieve high quality images on the media. Therefore, even if printer sensors are used, the printer sensors do not communicate with the printer itself so as to adjust printer settings or parameters based upon information about the print media or ribbon.

SUMMARY

The present invention includes a method of media identification for use in automatically adjusting one or more of a printer's settings according to the type of media inserted into the printer. The printer has a control circuit assembly in communication with a sensory system and a database located in a storage medium. The database includes a record of one or more media types and one or more parameter settings corresponding to each media type. The method comprises: obtaining a media identifier from a media loaded into the printer using the sensory system, determining the media type using the media identifier, retrieving, from the database, the defined parameter setting(s) corresponding to the media type identified by the media identifier, determining instructions to adjust the at least one system of the printer according to the defined parameter settings, sending the instructions to the at least one system of the printer to adjust the setting(s) according to the defined parameter setting retrieved.

The printer utilized in the present method may further comprise a media feed path. The sensory system may comprise at least one sensor along the media feed path.

The sensory system utilized in the present method may comprise a media type sensor. Alternatively, the sensory system may comprise a media presence sensor and a media type sensor. In this case, the media presence sensor would detect when media is loaded into the printer and send an indication to the circuit board. The circuit board would then request the media identifier from the media type sensor.

The sensory system utilized in the present method may include one or more of a barcode reader, a radio frequency identification (RFID) sensor, a laser sensor, a light sensor, a core sensor, an electronic sensor, and an optical sensor. The media used may be ribbon and/or print media. The printer settings that are automatically adjusted may include print head element heat setting, image heat balance setting, print speed, print head pressure, ribbon supply tension, ribbon take-up tension, media rewinder tension, hub size, media role size, and ribbon motion.

An additional embodiment of the present invention is directed to a method of automatically adjusting one or more of a printer's settings according to user input of the type of media inserted into the printer. The printer has a control circuit assembly in communication with an input panel and a database located in a storage medium. The database includes one or more media types and one or more parameter setting corresponding to each media type. The method comprises: obtaining a media identifier from the input panel, determining the media type using the media identifier, retrieving, from the database, the defined parameter setting(s) corresponding to the media type identified by the media identifier, determining instructions to adjust the printer system(s) according to the defined parameter setting(s), and sending the instructions to the system(s).

The media used may be ribbon and/or print media. The printer settings that are automatically adjusted may include print head element heat setting, image heat balance setting, print speed, print head pressure, ribbon supply tension, ribbon take-up tension, media rewinder tension, hub size, media role size, and ribbon motion.

An additional embodiment of the present invention is directed to a method of automatically adjusting at least one setting of a printer using media identification. The method comprises: loading media into a printer having a control circuit, a media feed path, and at least one sensor along the media feed path, transmitting an indication from the at least one sensor to the control circuit that media has been loaded into the printer, wherein the media has a media identifier, transmitting a request from the control circuit to the at least one sensor for the media identifier, sensing, at the at least one sensor, the media identifier, transmitting the media identifier from the at least one sensor to the control circuit, determining, at the control circuit, the media type using the media identifier, transmitting a request, from the control circuit to a database, wherein the database has at least one defined parameter setting for at least one system of the printer, wherein the defined parameter setting corresponds to the media type, and wherein the request is for a defined parameter setting corresponding to the media type identified, determining, at the database, the defined parameter setting corresponding to the media type, transmitting the defined parameter setting from the database to the control circuit, determining the instructions necessary to adjust the at least one system of the printer accordingly to the defined parameter setting, transmitting the instructions to the at least one system of the printer; and adjusting the at least one system of the printer according to the instructions.

The media used may be ribbon and/or print media. The printer settings that are automatically adjusted may include print head element heat setting, image heat balance setting, print speed, print head pressure, ribbon supply tension, ribbon take-up tension, media rewinder tension, hub size, media role size, and ribbon motion.

BRIEF DESCRIPTION OF THE DRAWINGS

FIG. 24 is an exemplary table for use as the database according to an embodiment of the present invention.

DETAILED DESCRIPTION OF THE PREFERRED EMBODIMENT

A description of the preferred embodiments of the present invention will now be presented. In the subsequent description, reference is made to the drawings, also briefly described above. These drawings form a part of this specification and contain, by way of illustration, embodiments by which the invention may be practiced. These embodiments are not meant to be limiting and other embodiments may be utilized and structural changes may be made without departing from the scope of the invention.

The present invention includes methods of automatically adjusting various settings of a printer according to the type of media (print media and/or ribbon) loaded into the printer. Some example settings that may be adjusted include print speed, printhead pressure, printhead heat setting, and ribbon supply tension. These methods utilize one or more sensors of a printer to determine the type of media loaded into the printer and then adjust settings of the printer accordingly. Utilizing this method may save the user from having to manually enter and/or adjust printer settings each time a new type of print media and/or ribbon is loaded into the printer. It also may ensure that high quality images are produced on the particular type of media inserted by properly adjusting the settings to correspond with settings defined for achieving such quality on the particular media type.

Figure 1A:
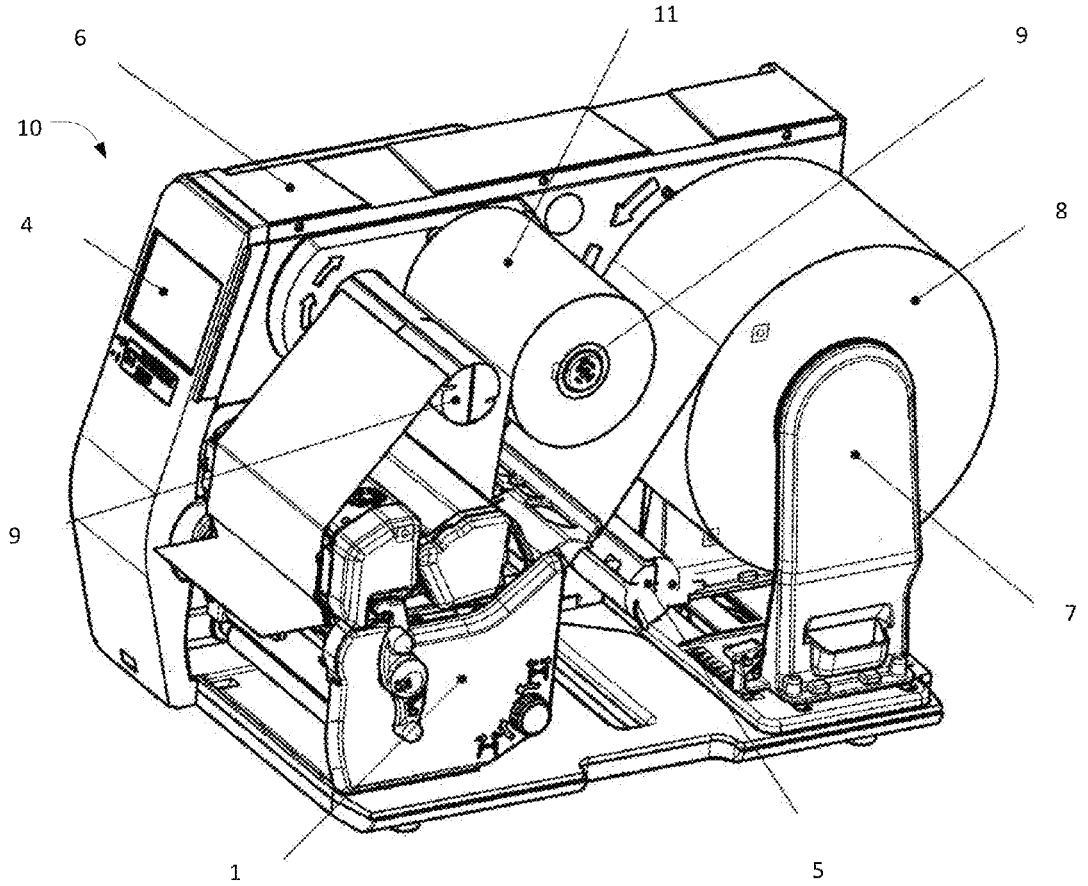
FIG. 1A is a front perspective view of an example printer that may be used in the execution of an embodiment of the present invention.
Figure 1B:
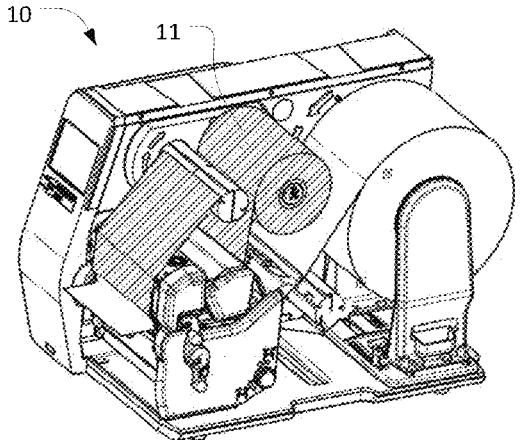
FIG. 1B is the same view of the example printer as shown in FIG. 1A with the media feed path of the ribbon highlighted.
Figure 1C:
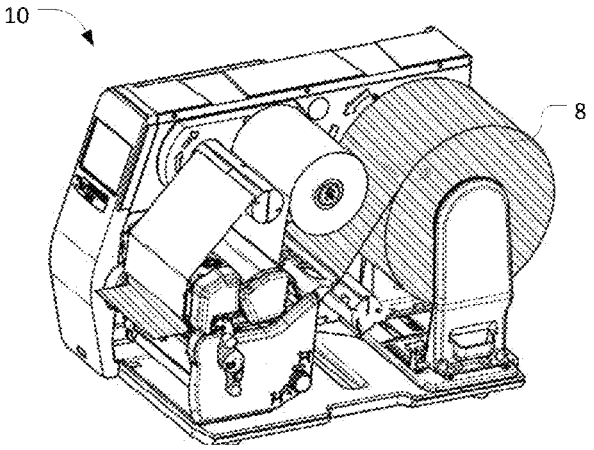
FIG. 1C is the same view of the example printer as shown in FIG. 1A with the media feed path of the print media highlighted.

FIGS. 1A 1B, 1C, and 2 illustrate front and rear perspective view of exemplary printer 10 upon which the embodiments of the present invention may execute. Exemplary printer 10 may include print station 1, power source 2, control circuit assembly 3, display panel 4, media hanger/hub 7, media rewind hub 5, media rewinder assembly 13, ribbon drive assembly 12, ribbon take-up hub 9. FIG. 1A also illustrates two types of media installed on printer 10—ribbon supply roll 11 and media supply roll 8. The shaded portion of FIG. 1B illustrates the media feed path of ribbon supply roll 11 and the shaded portion of FIG. 1C illustrates the media feed path of media supply roll 8.

Figure 2:
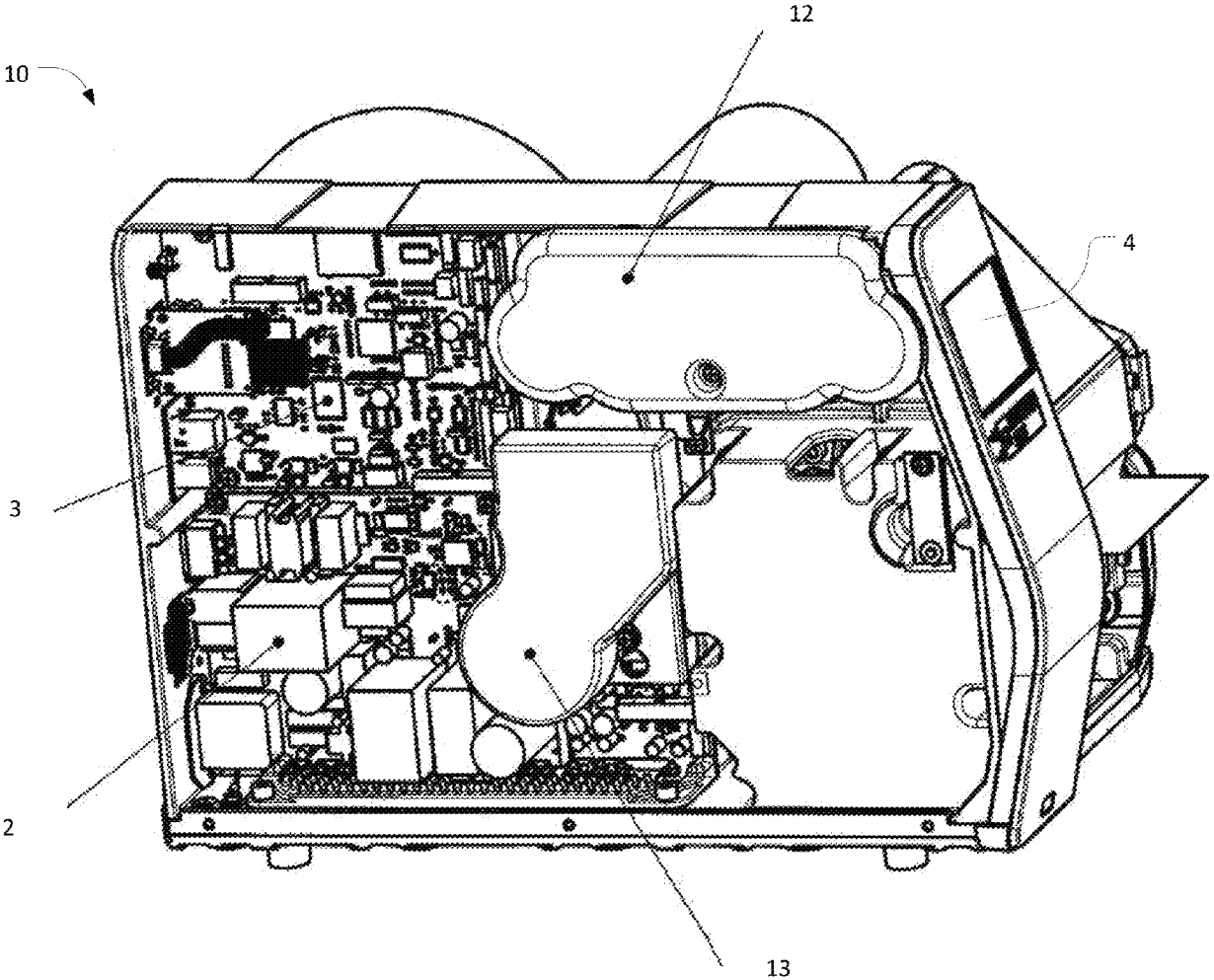
FIG. 2 is a rear perspective view of the example printer of FIG. 1A.
Figure 22B:
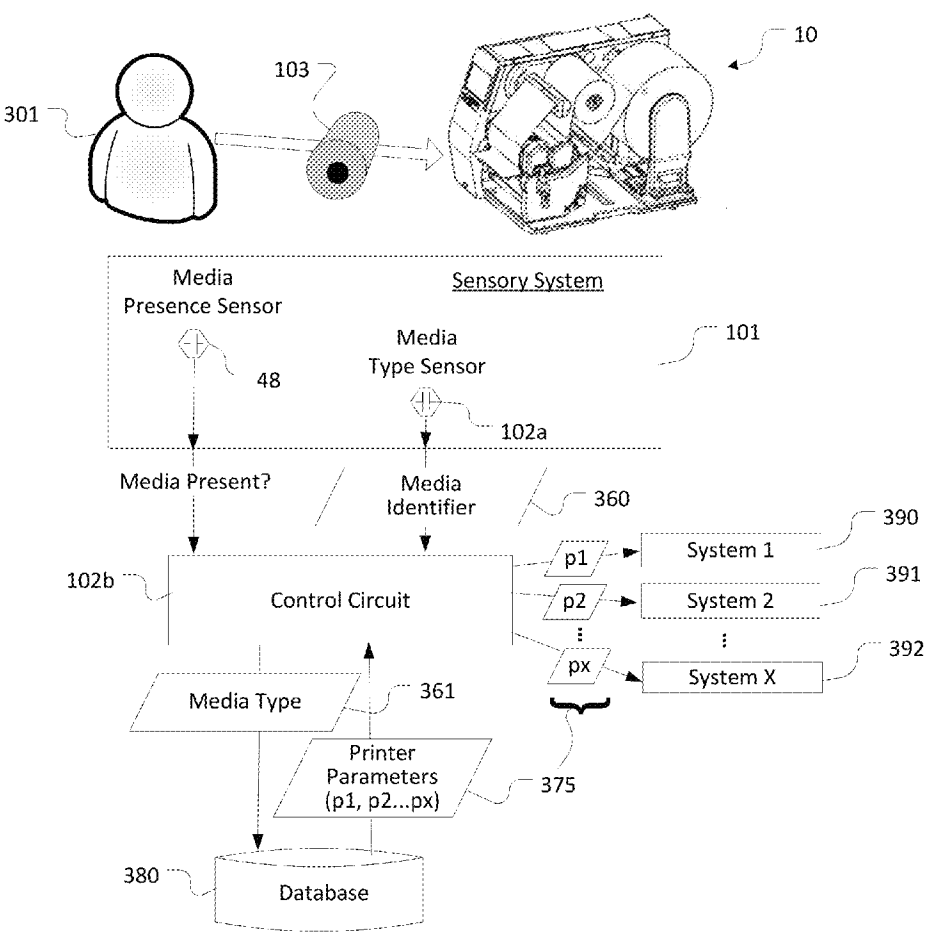
FIG. 22B is a diagram illustrating a method of media identification according to an embodiment of the present invention.

The exemplary printer from FIGS. 1A through 2 is used herein to illustrate methods of media identification for use in automatically adjusting one or more of a printer's settings according to the type of media inserted into the printer. As shown in FIG. 22B, user 301 inserts media 103 (print media and/or ribbon media) into printer 10. The media may either contain an identifier that can be sensed with a sensor, such as a barcode scanner/sensor, radio frequency identification (RFID) sensors or the media or media core (the cylinder upon which media is mounted) may have properties such as media width, or a notched core, that can be detected by a sensor, such as laser sensors, light sensors, electronic sensors, or optical sensors/scanners.

Figure 3:
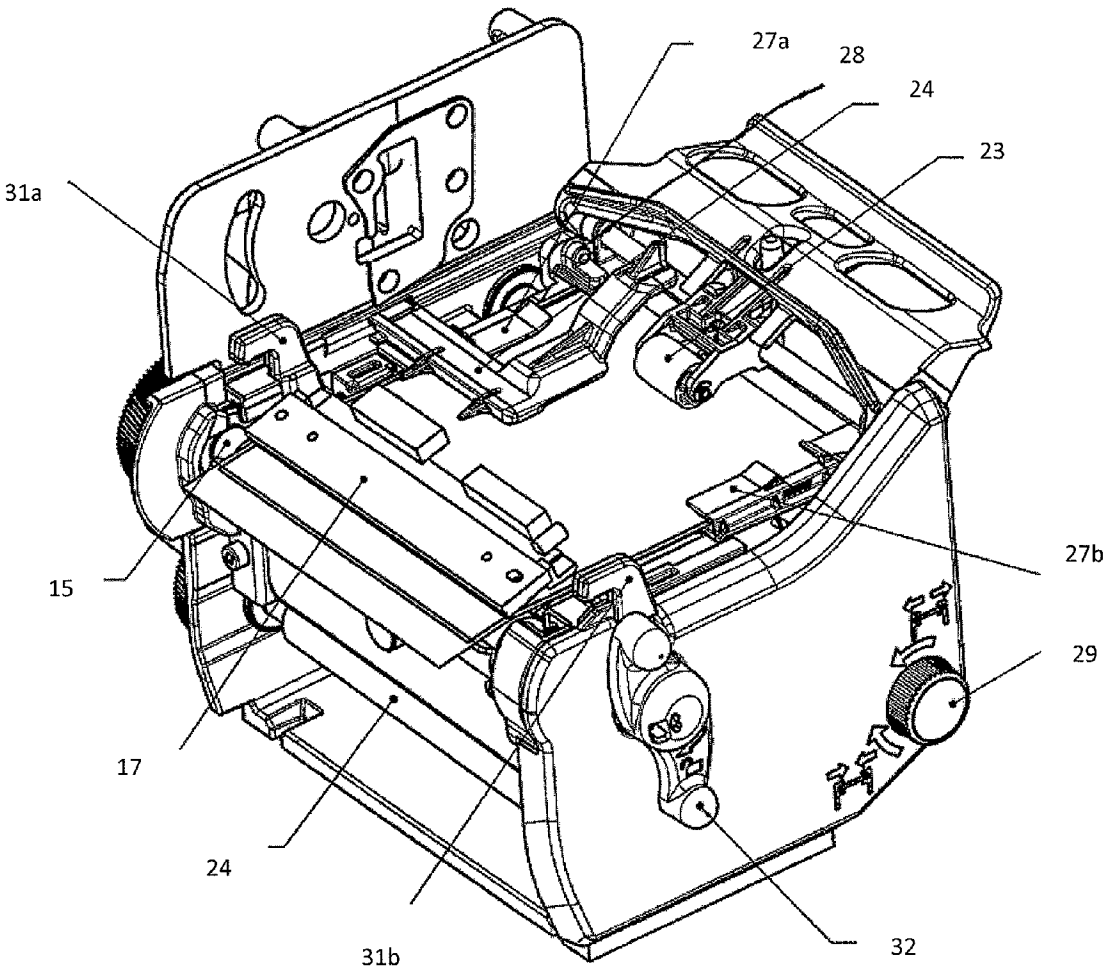
FIG. 3 is a perspective front view of an example print station of a printer with its printhead assembly removed that may be used in the execution of an embodiment of the present invention.
Figure 4:
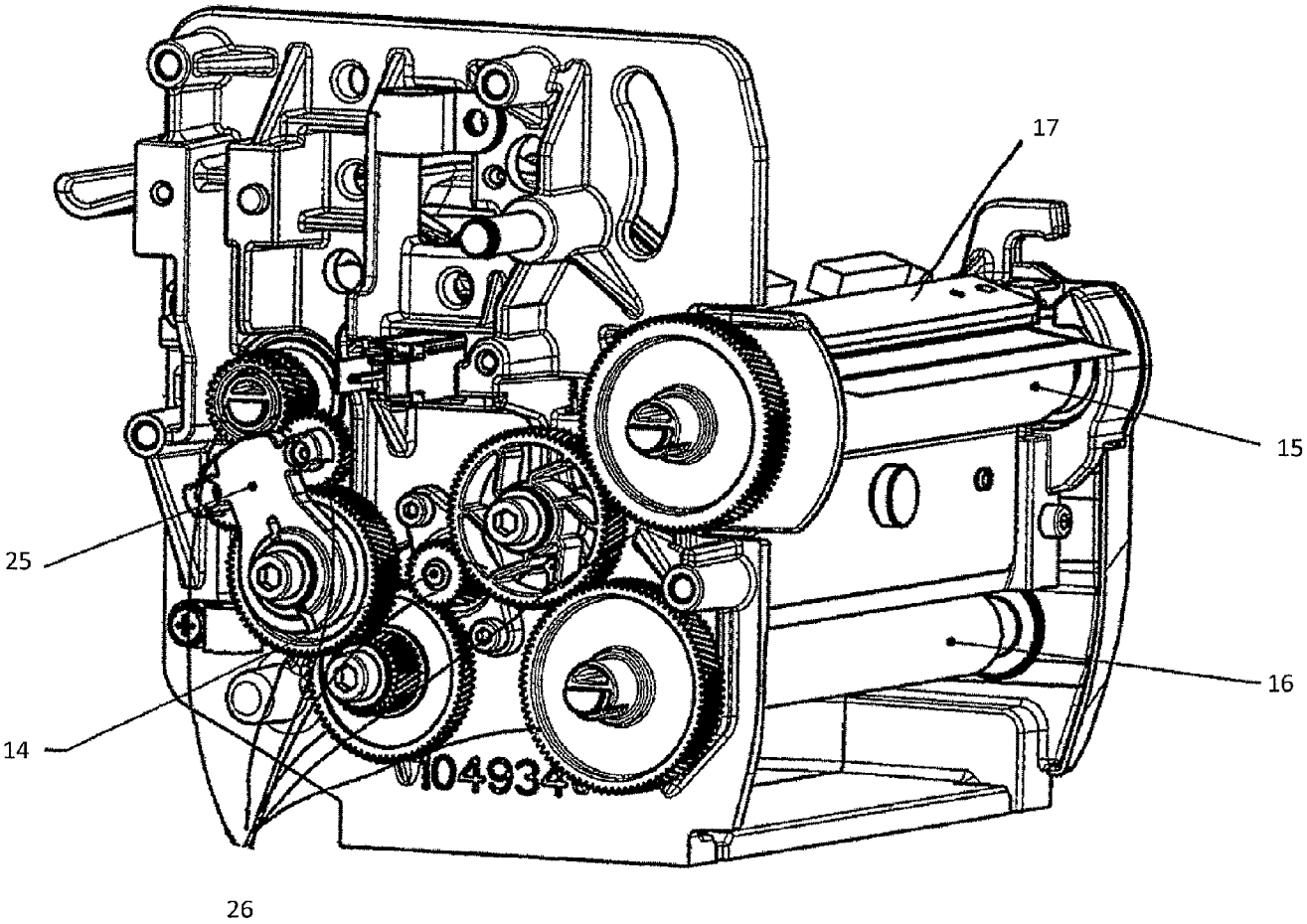
FIG. 4 is a perspective side view of the example print station of FIG. 3
Figure 5:
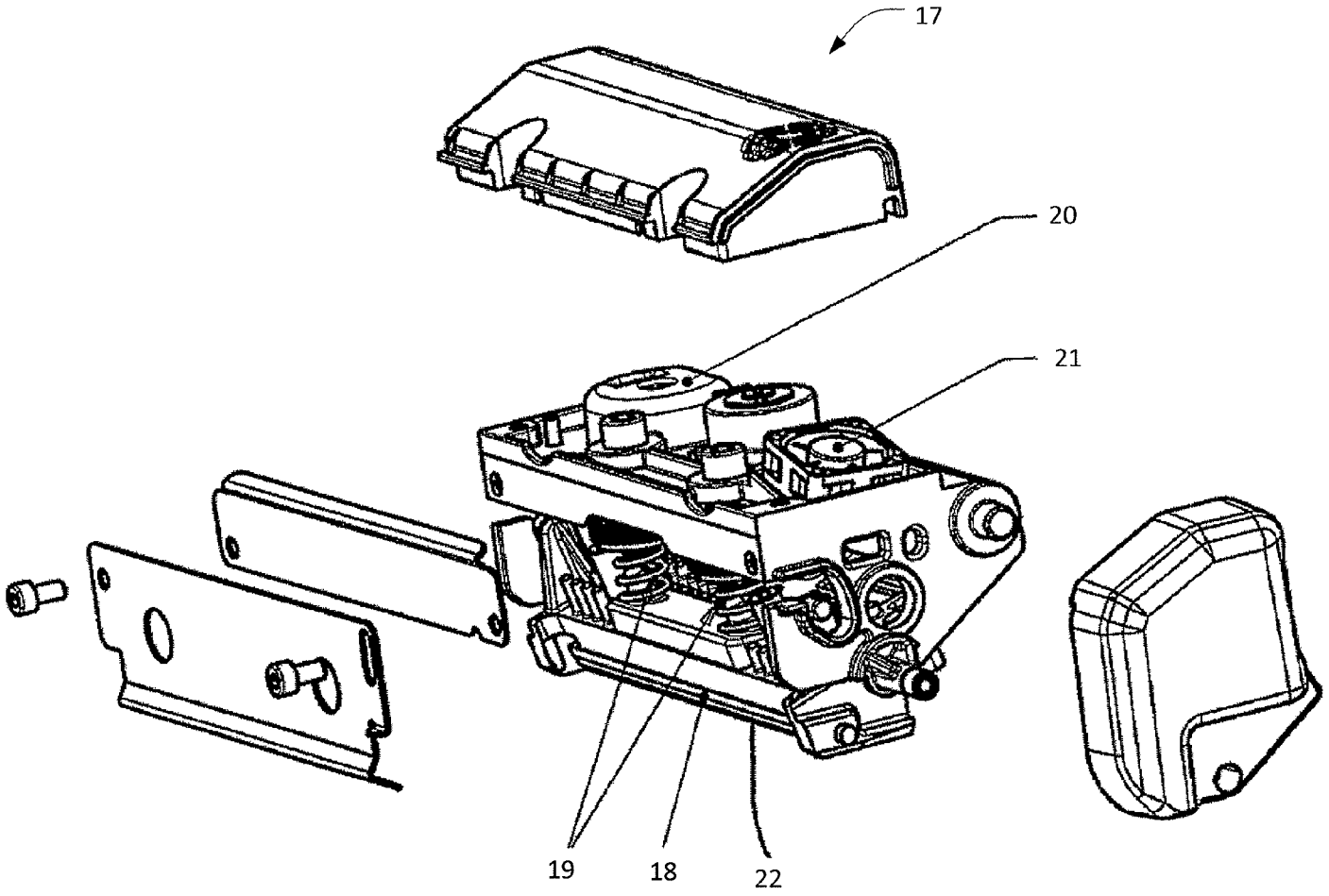
FIG. 5 is an exploded view of an example printhead assembly that may be used in the execution of an embodiment of the present invention.
Figure 6:
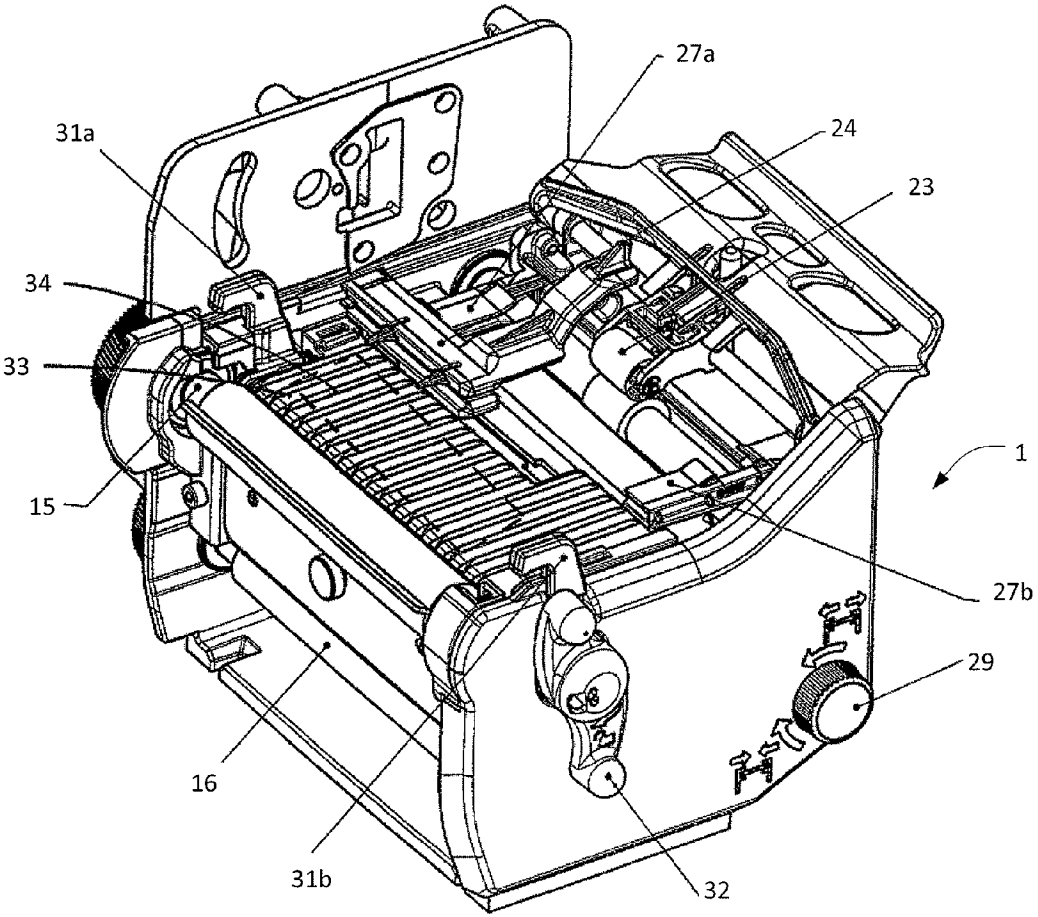
FIG. 6 is a perspective view of an example print station with an RFID receptacle and RFID antenna that may be used in the execution of an embodiment of the present invention.
Figure 7:
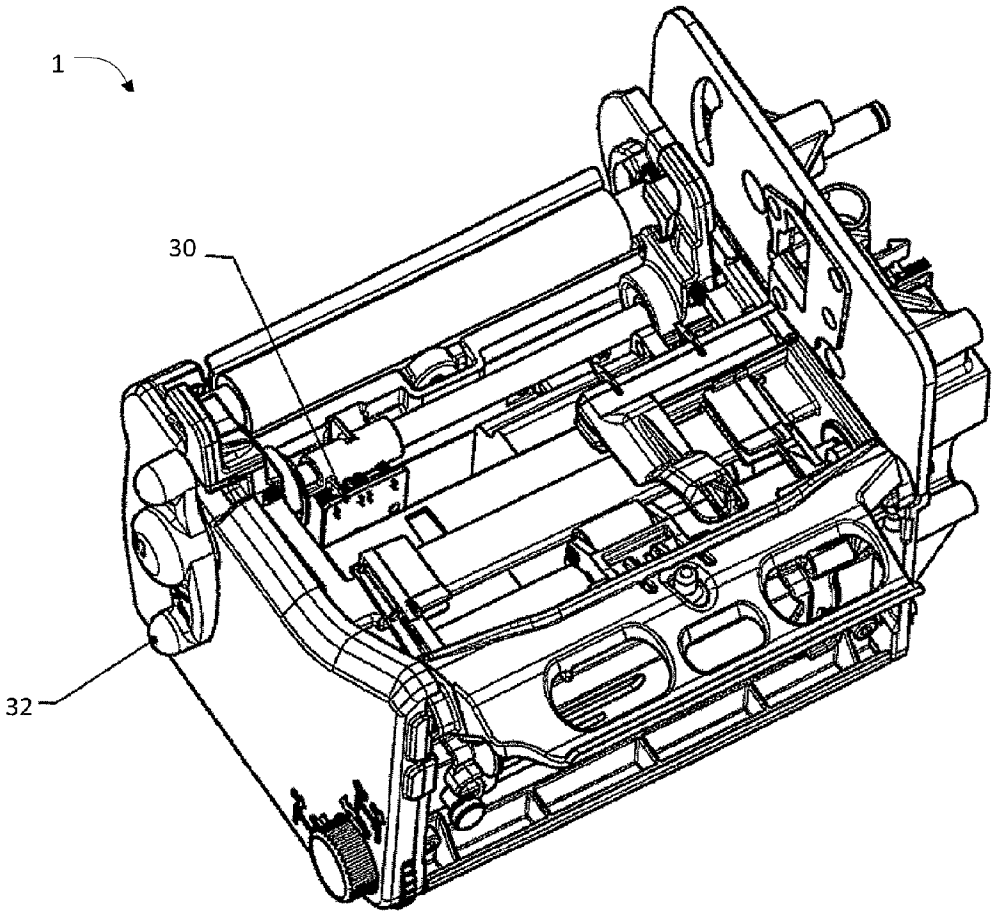
FIG. 7 is a perspective top view of an example print station that may be used in the execution of an embodiment of the present invention.
Figure 18A:
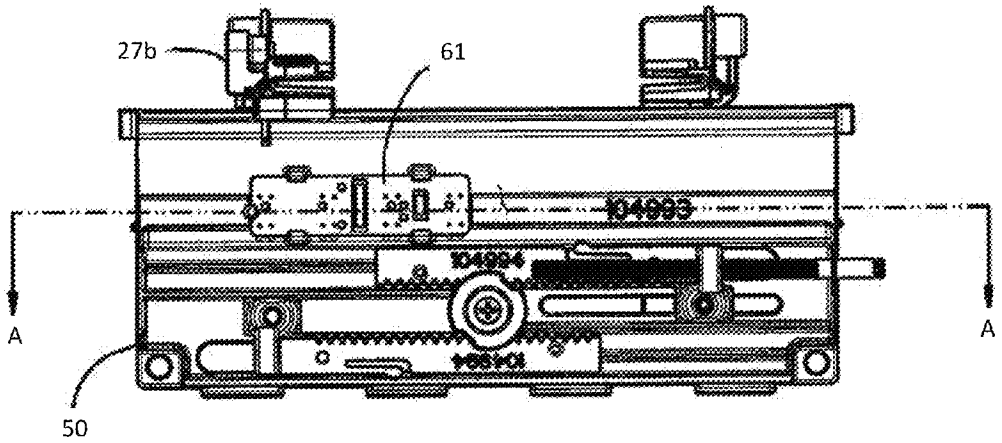
FIG. 18A is a bottom plan view of the example media guides of FIG. 14 with the media guides moved inward along the horizontal axis such that a light beam emitted from the sensor is not interrupted.
Figure 18B:
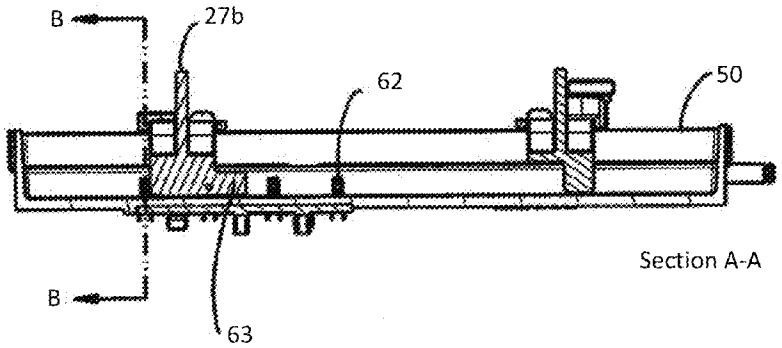
FIG. 18B is a cross-sectional view of the example media guides of FIG. 18A at the A-A axis.
Figure 18C:
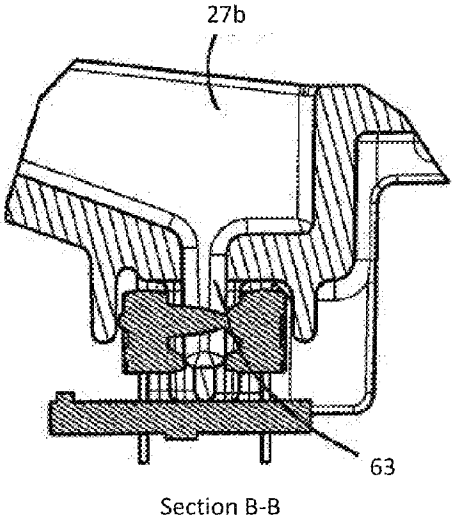
FIG. 18C is a cross-sectional view of the example media guides of FIG. 18B at the B-B axis.

Printer 10 then uses sensory system 101 to determine that media 103 is present. Sensory system 101 may include one or more of the sensors described in further detail below (e.g. media width sensor 61 (of FIGS. 15, 16, and 18A), media loading sensor 28 (of FIG. 3), media type sensor (of FIGS. 8 and 11), top-of-form sensor 24 (of FIG. 3), media presence sensor 48 (of FIGS. 8 and 11)), which may work independently or together in conjunction with each other to detect whether media (print media and/or ribbon) has been loaded into printer 10 and/or the type of media that has been loaded into printer 10. In this illustrative diagram, sensory system 101 comprises media presence sensor 48 and media type sensor 102*a*. Sensory system 101 may work independently or together in conjunction with control circuitry 102*b*. In exemplary printer 10, control circuitry 102(*b*) is a part of control circuit assembly 3 (FIG. 2). Once control circuit 102(*b*) determines that media is present using media presence sensor 48, control circuit 102(*b*) obtains media identifier 360 from media type sensor 102*a*. Media identifier 360 is used by control circuit 102*b* to determine the type of media (media type 361) that has been inserted into printer 10.

Printer 10 also includes database 380 in communication with control circuit 102(*b*). Database 380 includes one or more records of defined parameters for one or more of the printer's systems. Each record of defined parameters corresponds to a type of media. Such defined parameters may include any adjustable settings in printer 10, including, but not limited to, a print head element heat setting, an image heat balance setting, print speed, print head pressure, ribbon supply tension, ribbon take-up tension, media rewinder tension, hub size, media roll width, roll diameter, and/or motion and tension of ribbon.

The defined printer parameters may be preloaded, pre-stored, predefined, and/or manually entered into a database, on a storage medium located within the printer and/or in communication with the printer, such as, by way of non-limiting example, a computer in communication with the printer or an external storage drive in communication with the printer. As used herein, a database may refer to a traditional database containing a number of tables, a single table, or any similar means of storing one or more sets of data.

Once media type 361 is determined, it is used by the control circuit to retrieve defined printing parameters 375 of a matching record from database 380. Control circuit 102*b* then determines the instructions needed to adjust the printer's system(s) settings according to defined printing parameters 375 and sends the instructions to the appropriate systems 390, 391, 392, which, in turn, adjust the printer setting(s) according to defined printing parameters 375.

Figure 22A:
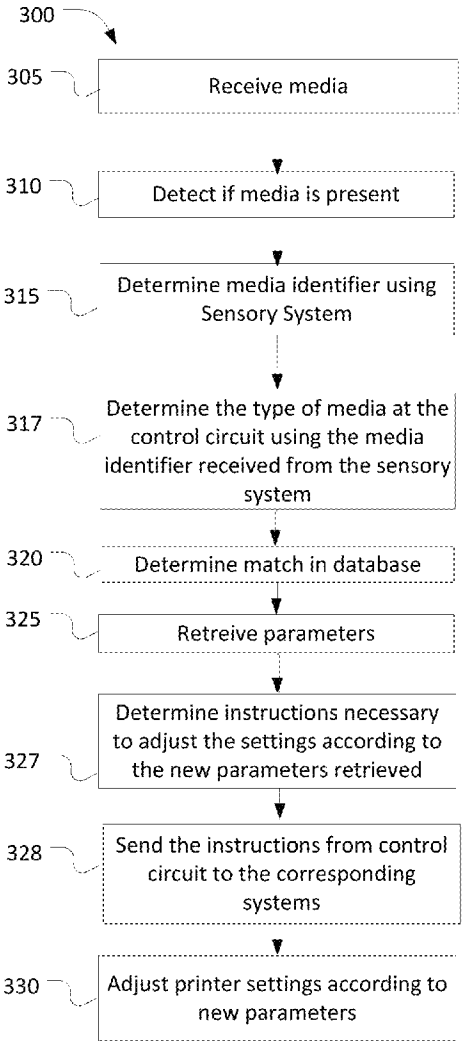
FIG. 22A is a flowchart showing a method of media identification according to an embodiment of the present invention.

Turning now to FIG. 22A, which is a flowchart illustrating a method of media identification 300 for use in automatically adjusting one or more of a printer's settings according to the type of media inserted into the printer. After the printer receives media, which may be print media and/or ribbon media (operation 305), the printer's sensory system is used to determine that media is present (operation 310). The sensory system obtains a media identifier which contains information about the media that is loaded into the printer (operation 315). The control circuit receives this media identifier and uses it to determine type of media that has been inserted into the printer (operation 317). The printer also includes a database in communication with the control circuit. The database includes defined parameter settings for one or more of the printer's systems corresponding to each type of media. The control circuit then uses the media type to retrieve defined parameter setting(s) from the database (operations 320 and 325). Once the defined parameter setting(s) have been retrieved, the control circuit then determines the instructions needed to adjust the settings according to the new parameters retrieved. (operation 327). The control circuit then sends the instructions to the appropriate systems (operation 328), which, in turn, adjust the printer setting according to the defined printer parameters (operation 330).

The sensory system may include one or more sensors. The one or more sensors may be located along the media feed path. By way of non-limiting example, these sensors may include barcode scanners/sensors, radio frequency identification (RFID) sensors, laser, light sensor, electronic sensor, optical sensors/scanners, and one or more sensors located on or near media hanger 7 (FIG. 1) and/or ribbon take-up hub 9 (FIG. 1) to determine whether or not notched cores are present on the media supply core.

Figure 23:
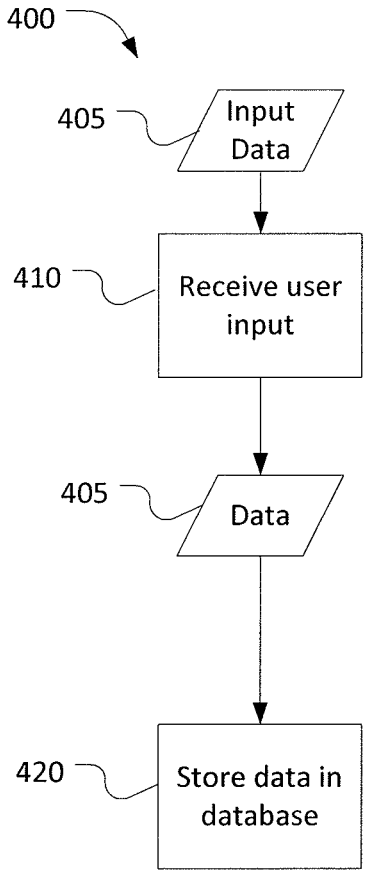
FIG. 23 is a flowchart illustrating an exemplary method of data entry into a printer's database according to an embodiment of the present invention.

As previously noted above, defined printer parameters may be preloaded, pre-stored, predefined, and/or manually entered into a database. An exemplary method of inputting data into the database (method 400) is illustrated in FIG. 23. A user inputs data 405 into a printer through, for example, an input panel. The printer receives data 405 input by the user (operation 410) and sends data 405 to a database where it is stored (operation 420). The database may be a simple as a lookup table. An example lookup table is shown in FIG. 24. In this example, data includes the media identifier, the media type, and the printing parameters—print length, print width, print speed, print head pressure, ribbon mode (coated in, coated out, non-coated), and heat balance.

Figure 25:
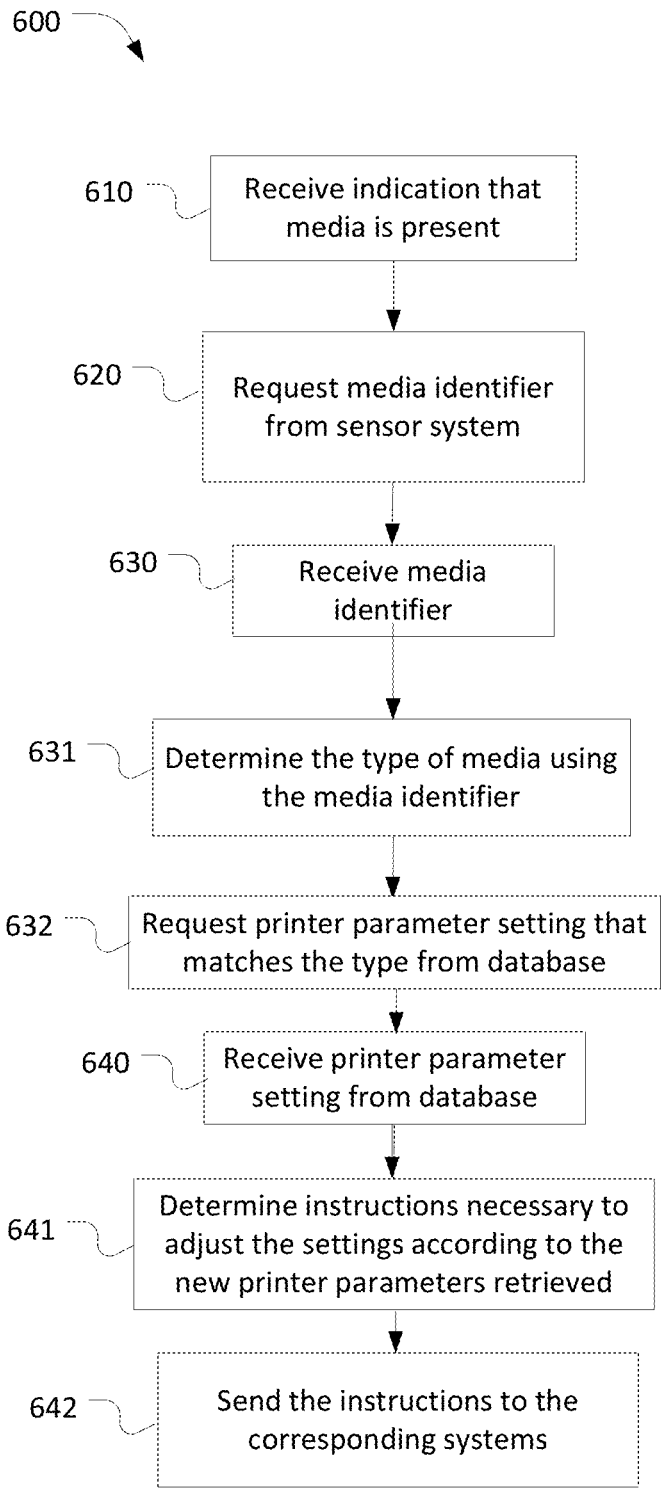
FIG. 25 is a flowchart showing a method of media identification for use in automatically adjusting a printer's setting(s) according to the type of media inserted into the printer from the perspective of the control circuit assembly according to an embodiment of the present invention.

FIG. 25 is a flowchart illustrating method 600, which uses automatic media detection to determine the type of media inserted into a printer, from the perspective of a control circuit. The control circuit may be located within the printer and/or in communication with the printer, such as, by way of non-limiting example, a computer in communication with the printer. In method 600, the control circuit receives an indication that media is present (operation 610). The media identifier is then requested from the sensor system (operation 620). Alternatively, media identifier may be sent directly to the control circuit as soon as sensor system determines the media is present (bypassing operation 620). Once the media identifier is received (operation 630), it is then used by the control circuit to determine the type of media (operation 631). The control circuit then uses this information to retrieve printer parameters from the database or lookup table (operation 632). Once the control circuit receives the printer parameters (operation 640), the control circuit determines the instructions needed to adjust the settings according to the new printer parameters received (operation 641). The control circuit then sends the instructions to the corresponding systems to adjust the printer settings accordingly (operation 642).

Figure 26:
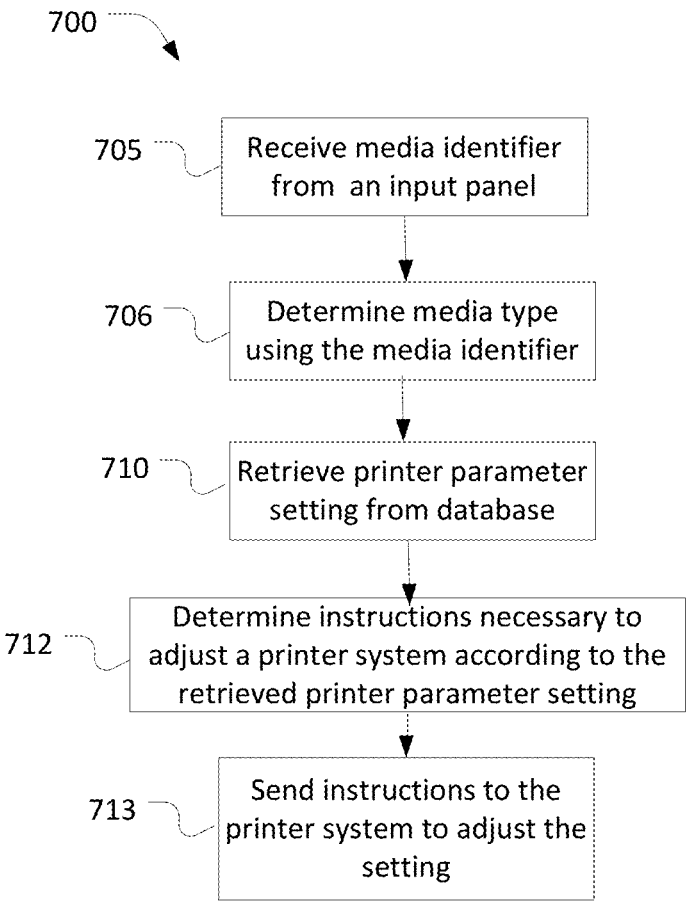
FIG. 26 is a flowchart showing a method of media identification for use in automatically adjusting a printer's setting(s) according to user input of the type of media inserted into the printer from the perspective of the control circuit assembly according to an embodiment of the present invention.

A user may manually enter or key in information about media that is loaded or will be loaded into the printer. FIG. 26 is a flowchart illustrating method 700, which uses manual entry, from the perspective of a control circuit. The control circuit may be located within the printer and/or in communication with the printer, such as, by way of non-limiting example, a computer in communication with the printer. In method 700, the media identifier or media type is received from the input panel of the printer (operation 705). The control circuit then uses the media identifier to determine the media type (operation 706). The media type is then used by the control circuit to retrieve printer parameters corresponding to the media type from the database or lookup table (operation 710). The control circuit then determines the instructions needed to adjust the settings according to the new printer parameters received (operation 712). The control circuit then sends the instructions to the corresponding systems to adjust the printer settings accordingly (operation 713).

Alternatively, the media identifier or media type may be retrieved through a menu. The menu may be accessible through the input/display panel on the printer, such as display panel 4 in FIG. 1A. Alternatively, the printer may be in communication with a device having a panel or display, such as a computer or portable electronic device, wherein a user may view and utilize the menu from the computer or device. The display may be touch screen or traditional. Once the user locates the proper media identifier or media type in the menu and makes the selection, the corresponding printer parameters are automatically retrieved from the database (similar to operation 710) and the control circuit determines the instructions needed to adjust the printer settings according to those parameters (as in operation 712). The control circuit then sends the instructions to the corresponding systems to adjust the printer settings accordingly (as in operation 713). In short, the menu permits a user to quickly and easily select the media that is or will be used in the printer.

Methods of the present invention can be utilized to automatically adjust the printer parameters for producing high quality images on the media. Alternatively, the method may be used to reduce ink usage by lowering by reducing ink quality for certain media that does not require high quality print. In addition, customer unique media combinations may also be entered, stored, and retrieved. The customer unique media combinations may be manually keyed in and stored, retrieved through the menu, or otherwise entered, stored, and/or retrieved.

The above described methods may be implemented in any printer. Further detail of an exemplary application using exemplary printer 10, which uses both a ribbon media and a print media, is given below.

Example Application

As discussed briefly above, FIGS. 1A and 2 are varying views of exemplary printer 10. Printer 10 may include print station 1, power source 2, control circuit assembly 3, display panel 4, and media rewind hub 5 in printer chassis 6. Printer 10 may also include media hanger/hub 7 for housing media supply roll 8 and ribbon take-up hub 9 for holding ribbon supply roll 11.

Power source 2 may be of any type or configuration including, but not limited to, an external power source, an internal power source, alternative current, direct current, battery, etc. Power source 2 provides a sufficient amount of power to operate the printer 10.

Display panel 4 is in operative communication with print station 1 and may be of any type and configuration. By way of non-limiting example, the display panel may be liquid crystal display (LCD), plasma, or any other type. Moreover, display panel 4 may be touch activated. Additionally or in the alternative, display panel 4 may be operatively connected to at least one button or other input wherein a user may input data or other information into printer 10. Moreover, display panel 4 may be secured on or within chassis 6, connected to print station 1, or otherwise be placed in communication with print station 1.

As discussed previously in regards to an alternate to method 700 illustrated in FIG. 26, display panel 4 may be used by methods of the present invention to adjust all printing parameters of printer 10. Such parameters include, but are not limited to, print location on the media, control of top-of-form sensor 24 (FIG. 3), and enabling or disabling optional features. Further, display panel 4 may be used to adjust the torque of the motors in ribbon drive assembly 12 and media rewinder assembly 13 for unique media. Display panel 4 may also be used to adjust the amount of power delivered to each element of printhead assembly 17 in print station 1 from power source 2.

Printer chassis 6 may provide a proper grounding for the electronic components of printer 10. Additionally, chassis 6 may provide a structurally sound frame for mounting components of printer 10.

Printer 10 aligns a media hanger/hub 7 with print station 1. As an example, center of media hanger/hub 7 may be aligned with a center of print station 1.

In another exemplary implementation of the method of the present invention, media width sensors 61 (FIG. 15), located in print station 1, may measure the width of the media passing through printer 10, along the media feed path, via control circuit assembly 3. Control circuit assembly 3 determines proper instructions based on a matching record from a lookup table and then relays this information to ribbon drive assembly 12, which adjusts the torque of motors 74 and 75 (FIG. 19) in proportion to the width of the media. The information may also be relayed to media rewinder assembly 13, which adjusts the torque of motor 77 (FIG. 25) in proportion to the width of the media.

Further description as to print station 1, media hanger/hub 7, ribbon drive assembly 12, and media width sensor 61 are provided below.

Print Station

FIGS. 3 through 7 depict varying views and embodiments of print station 1. Print station 1 includes motor 14, main platen roller 15, lower platen roller 16, and printhead assembly 17. Print station 1 may be easily inserted, removed from or otherwise incorporated into or integrated with a larger printer as desired, thereby permitting additional capabilities, functions, and options other than or in addition to those features provided by print station 1.

Printhead assembly 17 includes thermal printhead 18, compression springs 19, printhead pressure adjustment sensor 20 and fan 21. Printhead pressure adjustment sensor 20 determines the force within compression springs 19. Fan 21 cools thermal printhead 18 as needed. Temperature sensing member 22, such as a thermistor, may be located within thermal printhead 18 to control overheating of print station 1. Temperature sensing member 22 may be operatively coupled to a thermal heatsink to detect a thermal gradient generated therein. Temperature sensing member 22 may also be coupled to a controller in print station 1 which may adjust the target temperature of a heating element or may deactivate the heating element. In an exemplary implementation of methods of the present invention, these adjustments made be made in response to instructions from control circuit assembly 3, which were determined based on the type of media inserted into printer 10. Fan 21 may also be used to cool thermal printhead 18.

Print station 1 includes main platen roller 15 and lower roller 16. Main platen roller 15 is utilized for printing, while lower platen roller 16 is utilized for assisting with the rewinding of media onto rewind assembly 5.

Lower platen roller 16 may be slightly overdriven to maintain a tight web between main platen roller 15 and lower platen roller 16. A tight web is preferable for separating (or peeling) the labels off its corresponding backing.

Print station 1 also includes pinch roller 23 and top-of-form sensor 24. Top-of-form sensor 24 may be located between main platen roller 15 and pinch roller 23. Pinch roller 23 may be slightly under driven to maintain a tight web through top-of-form sensor 24. When print station 1 reverses direction during use, pinch roller 23 is then slightly overdriven in order to maintain the web tight through top-of-form sensor 24. Rocker arm 25 and associated gears 26 permits movement of the print media in a forward and reverse direction. Platen rollers 15, 16 and pinch roller 23 may be easily removed and replaced in the event they become damaged during use or abuse of print station 1.

Top-of-form sensor 24, which may be included in the sensory system of an exemplary application, may be included in print station 1 to determine a location of an initial portion of a web fed to print station 1 and to properly align the printed information onto the media. Top-of-form sensor 24 may also determine and provide a signal when the initial portion of the web is located at a desired location within print station 1. Top-of-form sensor 24 may utilize, by way of non-limiting example, barcode scanners, light emitting diodes (LEDs), radio frequency identification (RFID) sensors, lasers, photo sensors, electronic sensors, light sensors, optical scanners or sensors (such as beams), and/or other notification and sensing means that permit for sensing indicators on the media. Top-of-form 24 may be capable of sensing the following non-limiting exemplary indicators: black marks on the top side or under side of the media, holes thru or slots on the side of the media, top edges of label stock media, barcodes on media, RFID tags on media, identifiers printed on media, and any other errors, inconsistencies, or faults which may arise relative to positioning of and/or printing on the media.

Media guides 27*a* and 27*b* are included in print station 1 and may be located prior to pinch roller 23 to guide the media along the center line of print station 1. Media guides 27*a*, 27*b* each may contain media loading sensors 28 which may be used to inform print station 1 that media is being fed into print station 1. Information from media loading sensors 28 may also be relayed to control circuit assembly 3 (FIG. 2) for use in identifying the type of media inserted into printer 10 (FIG. 1A) in order to properly adjust other printer settings. Print station 1 may pass the information to printhead pressure adjustment sensor 20 located within printhead assembly 17. Printhead pressure adjustment sensor 20 adjusts compression springs 19 for the appropriate force setting. Further description as to the media hanger 27*a*, 27*b* is provided below.

Media adjustment knob 29 is provided to adjust the width of media guides 27*a* and 27*b*. Further, media adjustment knob 29 may be self-locking, which would result in no longer requiring print station 1 to lock media guides 27*a* and 27*b* in position.

Motor 14 is provided to power print station 1. Motor 14, which may be a drive-stepper motor, is geared to platen rollers 15, 16 such that a full step of motor 14 corresponds to a media movement. A non-limiting example of such media movement may be 1/300th of an inch. Continuing the non-limiting example, with 300 dot per inch printhead assembly 17 such movement would result in a 300×300 dots per inch area of print. Additionally, motor 14 may be operated in half-step mode. As a non-limiting example of the results achieved using the half-step mode, the same gearing would result in a corresponding movement of 1/600th of an inch, with a 600 dot per inch printhead assembly 17 and 600×600 dots per inch area of print.

Motor 14 may be a direct current (DC) or alternative current (AC) driver motor, which may include an attached encoder disk that may be used to drive print station 1. Print station 1 may establish a corresponding timing for 300, 600, or other dots per inch printing by determining the proper number of slots in the encoder disk.

Latch sensor 30 may be included to send a signal to print station 1 of the position of latches 31*a*, 31*b*. Latch sensor 30 may also sense when the latch 31*a*, 31*b* is closed, fully opened, or a variety of positions there between. Latch handle 32 permits manipulation of latches 31*a*, 31*b* as desired.

Print station 1 may also include receptacle 33 for mounting radio-frequency identification (RFID) antenna 34. Receptacle 33 may be located prior to main platen roller 15. RFID antenna 34 may be used to imprint RFID data onto a chip embedded in a label. After the chip in the label is programmed with data, the label is then thermally printed. In the alternative, RFID antenna 34 may be directly located on or incorporated in print station 1.

Because print station 1 is stand-alone, it may be easily inserted, removed from, or otherwise incorporated into or incorporated with a larger printer as desired, thereby permitting additional capabilities, functions, and options other than or in addition to those features provided by print station 1.

Media Hanger (Having Media Presence Sensor)

FIGS. 8-13 depict varying views and embodiments of media hanger/hub 7 which may be utilized in print station 1. Media hanger/hub 7 may include base plate 35 having first surface 36 and second surface 37 opposed to first surface 36, guide 38 extending into second surface 37, first support member 39 and second support member 40 adapted for sliding movement along guide 38 relative to base plate second surface 37, and pivot 41 secured to base plate second surface 37 and engaged with support members 39 and 40 such that pivot 41 is movable between a first position adapted for permitting insertion of a media (not shown) between first support member 39 and second support member 40 and a second position adapted for providing force on first support member 39 and second support member 40. Slot 42 may also extend into second surface 37. Optional lock 43 may be movably secured to base plate 35 for locking first and second support members 39 and 40 in a predetermined position along base plate 35.

Pivot 41 may include link arm 44 extending therefrom. The point wherein pivot 41 is rotatably secured to base plate second surface 37 may be referred to as the pivot point. Link arms 44 are secured to support members 39 and 40, with such connection preferably located at the distal ends of link arms 44, although connections along other locations along link arms 44 is also contemplated. Biasing mechanism 45 is secured to pivot 41 such that upon rotation of pivot 41 at its pivot point to the second position, a compressive force is exerted so as to move support members 39 and 40 toward one another along guide 75. Biasing mechanism 45 may be any type of biasing mechanism including, but not limited to, a torsion spring.

Support members 39 and 40 may include mounting plates 46 located on the bottommost portion of support members 39 and 40. Mounting plates 46 are preferably sized and shaped so as to permit support members 39 and 40 to movably slide along guides 75 when pivot 41 is manipulated. Link arms 44 are most preferably secured to mounting plates 46 of support members 39 and 40.

Figure 10:
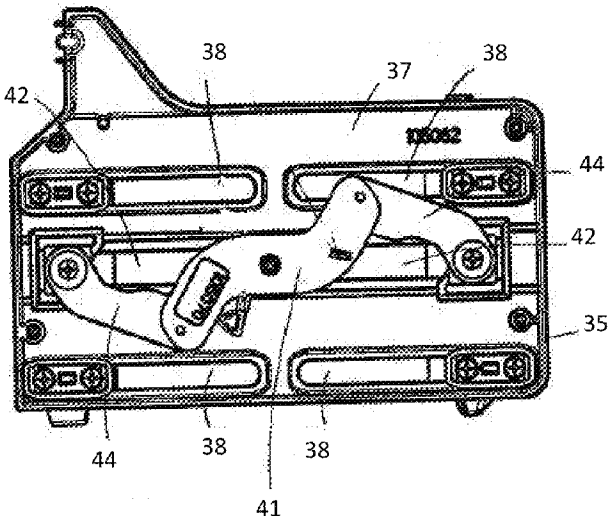
FIG. 10 is a bottom view of the example media hanger/hub of FIG. 8.
Figure 9:
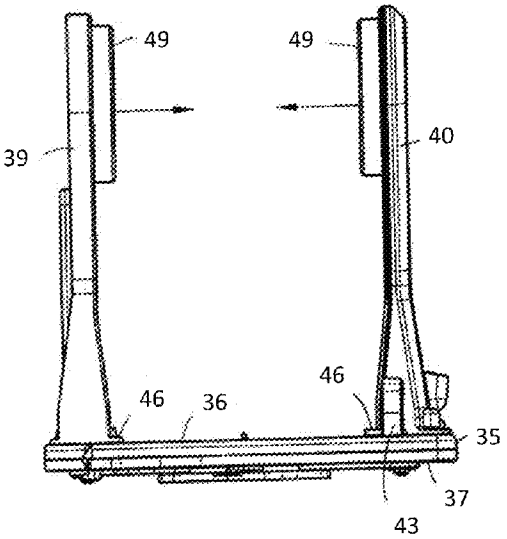
FIG. 9 is a front view of the example media hanger/hub of FIG. 8.
Figure 8:
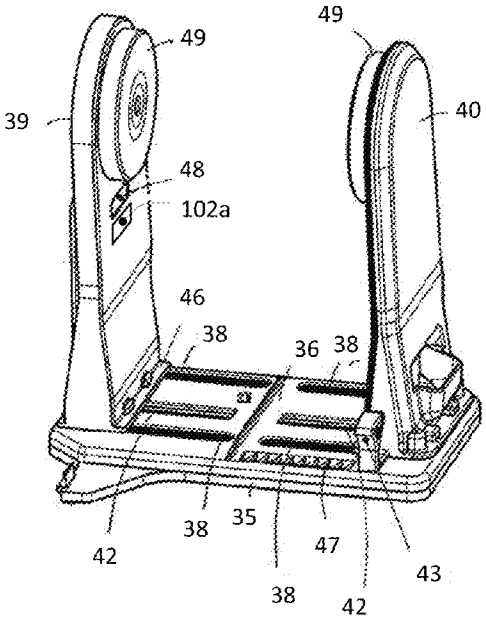
FIG. 8 is a perspective front view of an example media hanger/hub in an open position that may be used in the execution of an embodiment of the present invention.

Lock 43 is utilized to hold media hanger/hub 7 in an uncompressed position as shown in FIGS. 8-10. Notches 47 may be located on base plate top surface 37. Notches 47 are sized and shaped so as to accommodate lock 43 in a fixed position, thereby maintaining support members 39 and 40 in the second position. Because plurality of notches 47 are located on first surface 36, lock 43, and thus support members 39 and 40, may be manipulated such that support members 39 and 40 may lock and remain in various positions along guide 38 and relative to base plate 35. Maintaining support members 39 and 40 in various positions along guide 38 is especially desired when using fan-fold media.

Media presence sensor 48 may also be located on support member 39 or 40. Media presence sensor 48 is adapted to detect the presence and/or absence of media in the media hanger and is in communication with control circuitry (not shown). Media type sensor 102*a* may also be located on support member 39 or 40. Media type sensor 102*a* is adapted to detect the type of media in the media hanger. Alternatively, media presence sensor 48 may be adapted to both detect the presence and/or absence of media and the type of media. Media presence sensor 48 and/or media type sensor 102*a* may be an optical scanner/sensor, a mechanical sensor, a photo sensor, an electronic sensor, a laser scanner, a light sensor, a barcode scanner/reader, an RFID scanner/reader, or any other suitable scanner or sensor as known in the art. In accordance with example applications of method of the present invention, the presence or absence of media, as determined by media presence sensor 48 and/or media type sensor 102*a*, influences functions of printer 10 (FIG. 1A) according to programming within the control circuitry and/or the programming of control circuit assembly 3 (FIG. 2). Media presence sensor 48 and media type sensor 102*a* may be used with roll media, although use of the sensor in conjunction with media of other types is also contemplated.

Additionally, media hanger/hub 7 may include hubs 49 of varying sizes, including, but not limited to, 3", 1.5", 1", or a combination thereof. Hubs 49 may be fixed or interchangeable, and are used for holding media of various sizes.

Figure 13:
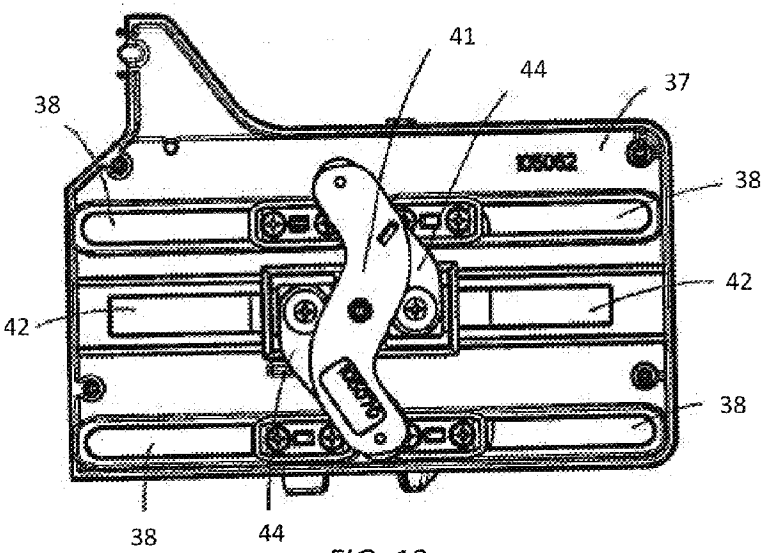
FIG. 13 is a rear view of the example media hanger/hub of FIG. 11.
Figure 12:
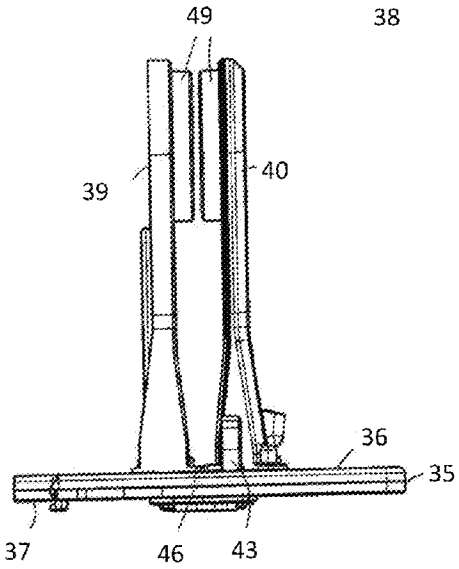
FIG. 12 is a front view of the example media hanger/hub of FIG. 11.
Figure 11:
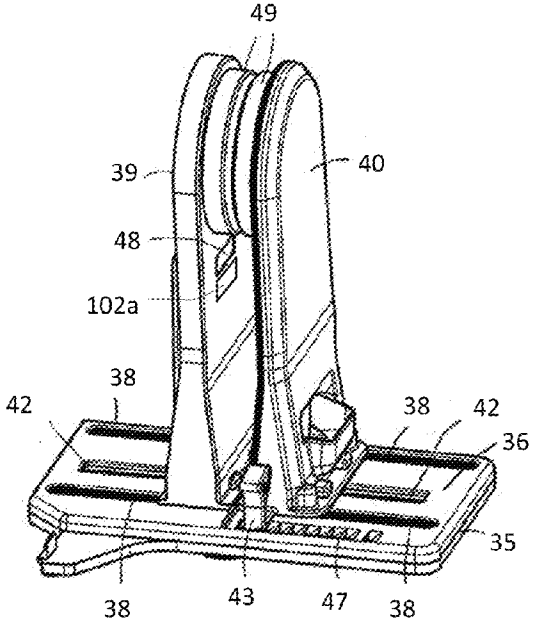
FIG. 11 is a perspective front view of the example media hanger/hub in a compressed position that may be used in the execution of an embodiment of the present invention.

With specific reference to FIGS. 11-13, various views of media hanger/hub 7 in a compressed position are shown. The compressed position is when compressive forces are applied to the first and second support members 39 and 40 so as to retain the media within media hanger/hub 7. The compressed position is achieved by manipulating pivot 41 such that pivot 41 is rotated about its pivot point, thereby resulting in movement of link arms 44 and, thus, exertion on biasing mechanism 45.

A media is inserted within media hanger/hub 7 when the distance between support members 39 and 40 permit accommodation of the media. Such first position permits loading of rolled media, use of media hanger/hub 7 for fan-fold media, or any other use of media hanger/hub 7. Pivot 41 is then manipulated so as to move the support members 39 and 40 toward one another along guide 38 to a desired distance between support members 39 and 40. Such manipulation of pivot 41 results in simultaneous and synchronized movement of support members 39 and 40. Because such simultaneous and synchronized movement occurs, the media is centered within media hanger/hub 7. Compressive forces applied on the media is constant, as opposed to linear, and such forces are not dependent upon the media width. The compressive forces are dependent upon a combination of factors, including, but not limited to, initial load on biasing mechanism 45, the stiffness of biasing mechanism 45, the pivot point geometry of pivot 41, and the length of link arms 44. The compressive force is a constant force and decreases vibration of the media, which in turns decreases the likelihood of the media rolling off of media hanger/hub 7 and decreases the likelihood of blurred or offset printing.

Media Width Sensor

With reference to FIGS. 14-18, varying views of media guides 27*a*, 27*b* for feeding original image media and/or printable media into a printer 10 and for determining the width of the inserted media at print station 1 location are shown. In example embodiments and as shown in FIGS. 14-18, printing system media feeding apparatus 100 is provided, including base 50 to support media (not shown) being fed into system 100, base 50 having top and bottom surfaces 51 and 52. First and second media guides 27*a*, 27*b* are provided about bottom surface 52 of base 50 extending outward and about a side of base 50. Guides 27*a*, 27*b* are movably attached to base 50 such that they are operable to engage opposite sides of the media being fed between the guides.

In example embodiments, both guides 27*a* and 27*b* are slidable along a horizontal axis (A-A) of base 50 in synchronism via rack and pinion system 53 and when pushed together, guides 27*a* and 27*b* centrally register the inserted media and help ascertain the width thereof. More specifically, guides 27*a* and 27*b* are mounted to first and second racks 54 and 55 coupled by pinion gear 56 on the top surface 51 of base 50 that cooperatively provide for synchronous translation of guides 27*a* and 27*b* in a rack and pinion arrangement by which guides 27*a* and 27*b* can be pushed together to centrally register the media. In example embodiments, rack and pinion system 53 is located about top surface 51 of base 50 and is connected to guides 27*a* and 27*b* via screws 57, 58, that extend through base 50 at predefined slots 59, 60.

System 100 may further include a media width sensing apparatus, or media width sensor 61, providing electrical signals used to ascertain the width of registered media between media guides 27*a* and 27*b*. Media width sensor 61 is mounted in a fixed position relative to top surface 51 of base 50 and guides 27*a*, 27*b*. Media width sensor 61 is adapted to detect the presence and/or absence of an obstruction and is in communication with control circuitry (not shown). In an example application, the control circuitry determines the width of the media based on signals received from media width sensor 61. The control circuitry may include a microcontroller with associated memory. The control circuitry may oversee movement of the media sheet along the entire media feed path, or may just determine the width of the media as it moves through the print station and about media width sensor 61. Additionally or alternatively, media width sensor 61 is in communication with control circuitry assembly 3 (FIG. 2), which may use information from media width sensor 61 to determine the type of media loaded into the printer. Information on the type of media can then be used to alter other printer setting(s).

Media width sensor 61 may be an optical scanner/sensor, a mechanical sensor, an electronic sensor, a laser scanner, a light sensor, or another suitable sensor as known in the art. In the example described herein, media width sensor 61 is an optical sensor. Media width sensor 61 is provided with at least one light emitting device (LED) which is operable for emitting at least one light beam through at least one aperture 62 of the base 50. Media width sensor 61 is operable for detecting an obstruction to the emitted light beam and includes a transmitter (not shown) and a receiver (not shown). The transmitter emits a signal that is detectable by receiver. In one embodiment, the signal is electromagnetic energy. Thus, the transmitter emits optical energy with a frequency spectrum that is detectable by receiver. The transmitter may be embodied as an LED, laser, bulb or other source. The receiver changes operating characteristics based on the presence and quantity of optical energy received. The receiver may be a phototransistor, photodarlington, or other detector. The optical energy may consist of visible light or near-visible energy (e.g., infrared or ultraviolet). The presence or absence of an obstruction, as determined by media width sensor 61, influences functions of a printer according to programming within the control circuitry. Media width sensor 61 may be used with roll media, although use of the sensor in conjunction with media of other types is also contemplated. Also, in exemplary applications, the media width resolution of media width sensor 61 is:

$$\text{Res}=(\text{Max. media width}-\text{Min. media width})/(2*N-1),$$

where N is the number light beams emitted by the sensor.

At least one of media guides 27*a* and 27*b* include an optical obstruction structure (a tab) 63 that is operatively coupled to movable media guides 27*a* and 27*b* so as to move relative to at least one of the light beams emitted by media width sensor 61 when media guide 27*a* and/or 27*b* is moved relative to base 50 with tab 63 moving within a sensing gap (over the emitted light beam coming through the aperture) to block or otherwise interrupt the signal path.

Figure 14:
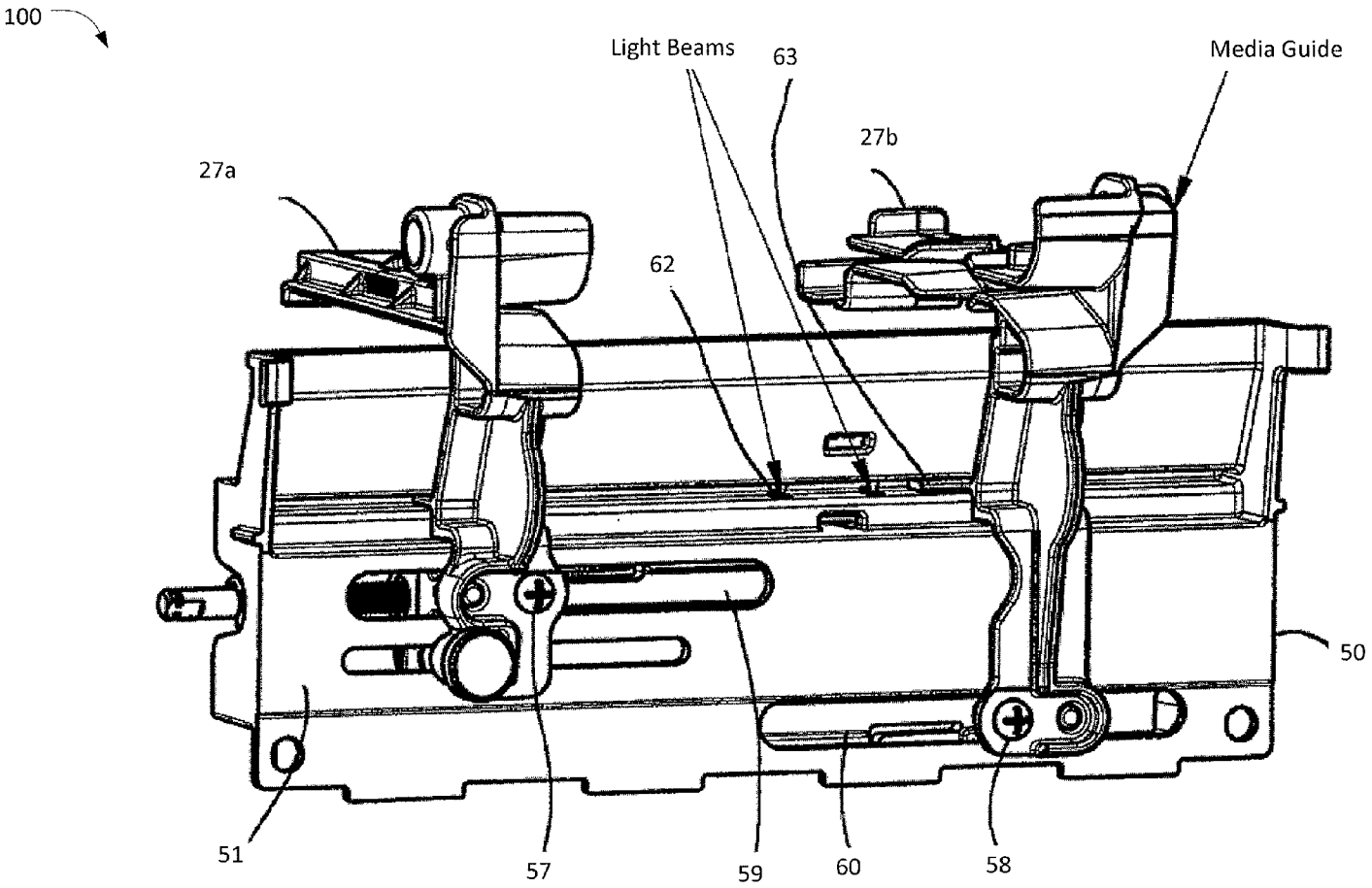
FIG. 14 is a perspective view of example media guides in an open position that may be used in the execution of an embodiment of the present invention.
Figure 15:
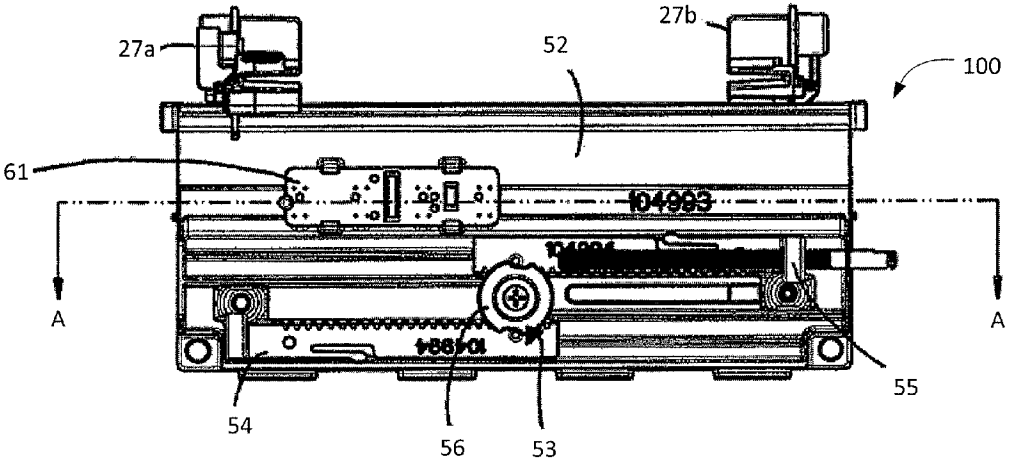
FIG. 15 is a rear plan view of the example media guides of FIG. 14.
Figure 16:
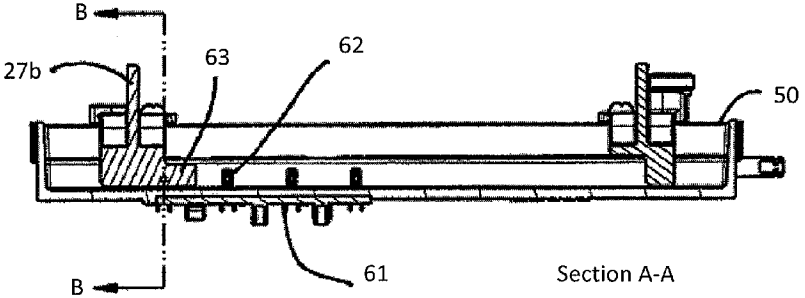
FIG. 16 is a cross-sectional view of the example media guides of FIG. 15 at the A-A axis.
Figure 17:
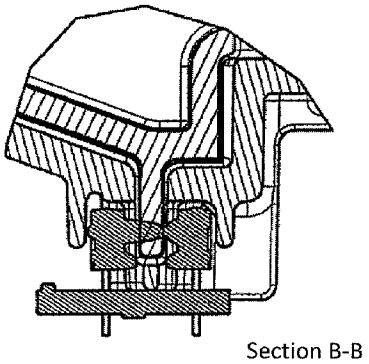
FIG. 17 is a cross-sectional view of the example media guides of FIG. 16 at the B-B axis with the media guides moved to a position such that a light beam emitted from a sensor is interrupted.

FIGS. 14-16 illustrate media guides 27*a*, 27*b* in a fully open position such that one of the light beams of media width sensor 61 are blocked or otherwise obstructed. Referring now to FIG. 17, guides 27*a*, 27*b* are moved inward along the horizontal A-A axis of base 50 such that tab 63 blocks an additional light beam emitted from media width sensor 61. Upon further closure of the media guides 27*a*, 27*b* additional light beams will be blocked, thereby providing the control circuitry with additional information to be used in the determination of the media width.

Further example embodiments provide a method for determining a media width in printer 10. The method comprises providing a base with first and second media guides, mounting a sensor in a fixed position relative to the print station. The base within print station 1 being provided with at least one aperture for permitting emitted light beams from the sensor to pass through. At least one of media guides 27*a* and 27*b* is provided with an optical obstruction structure such as a tab or fin which is located in a fixed position relative to media guides 27*a* and 27*b* to move relative to the emitted light beam when media guides 27*a* and 27*b* are moved relative to print station 1. Media guides 27*a* and 27*b* are then moved to register the media and electrical signals are read from media width sensor 61, with the media width being determined based at least partially on the electrical signals. In certain implementations, the width determination may include determining two or more possible media widths based on the electrical output signals from the sensor, rendering a selection of the plurality of possible media widths to a user, and determining the media width based on a user selection from a user interface of printer 10.

Ribbon Drive Assembly

Figure 19:
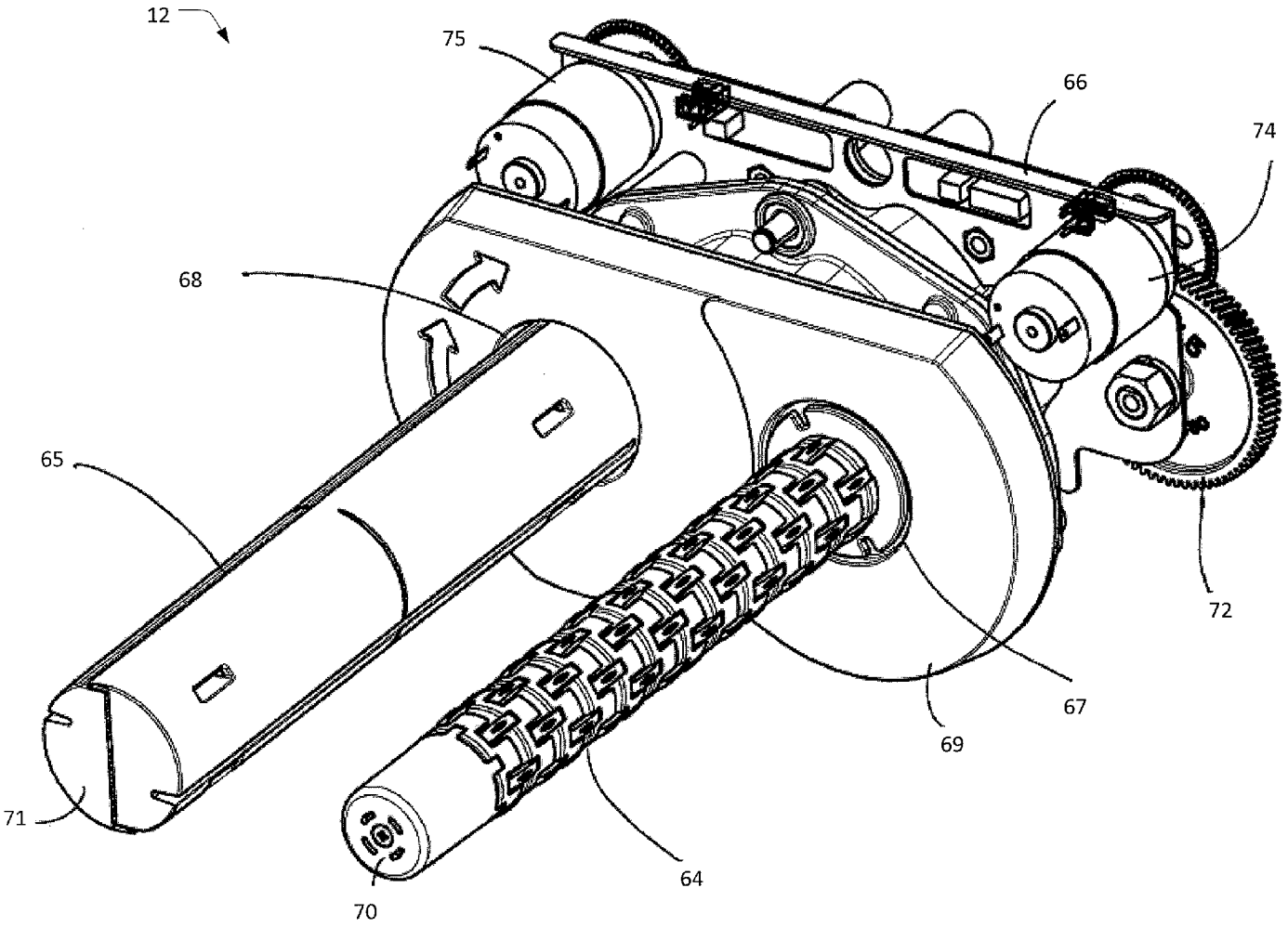
FIG. 19 is a perspective front view of an example ribbon drive assembly in an open position that may be used in the execution of an embodiment of the present invention.
Figure 20:
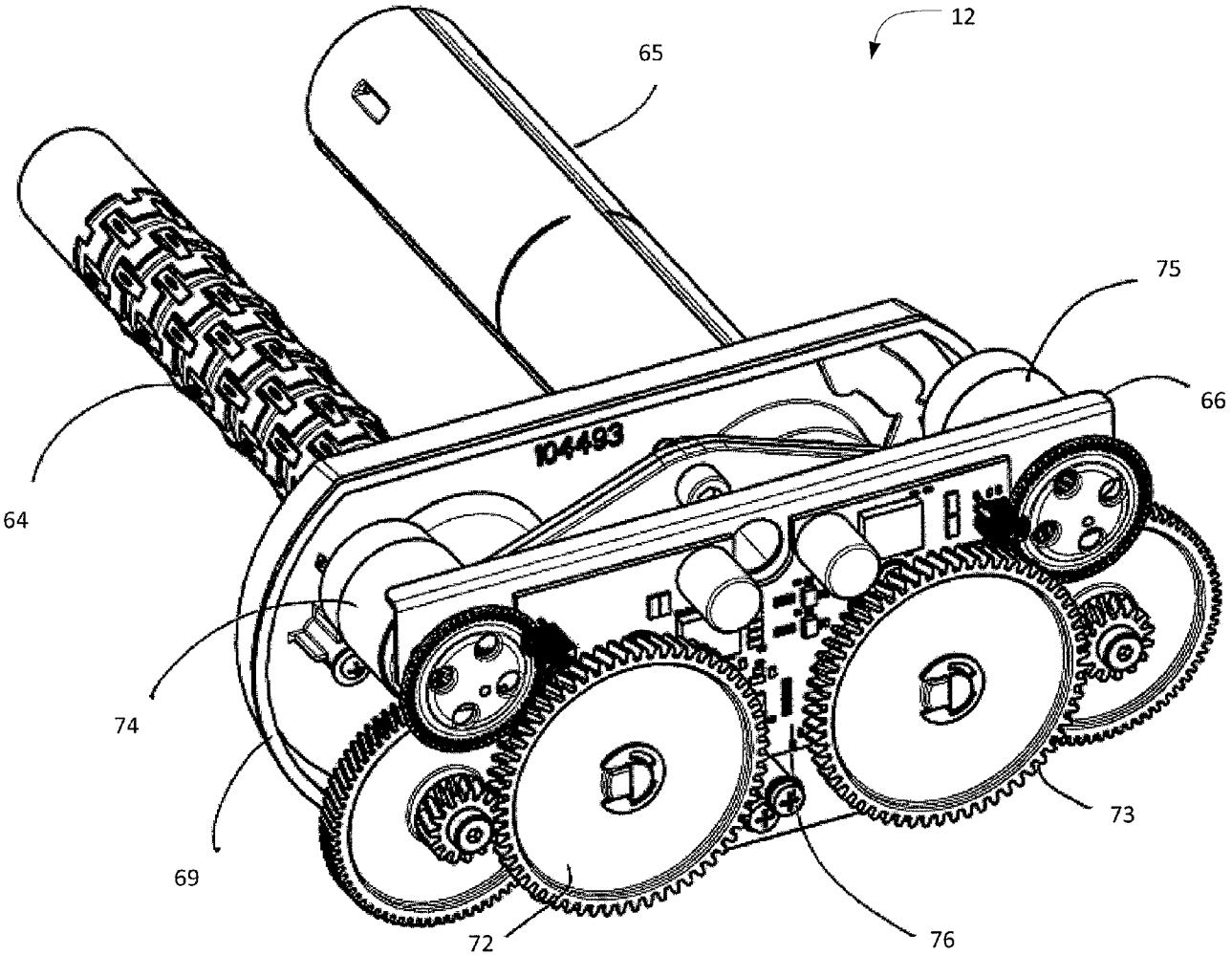
FIG. 20 is a perspective rear view of the example ribbon drive assembly of FIG. 19.
Figure 21:
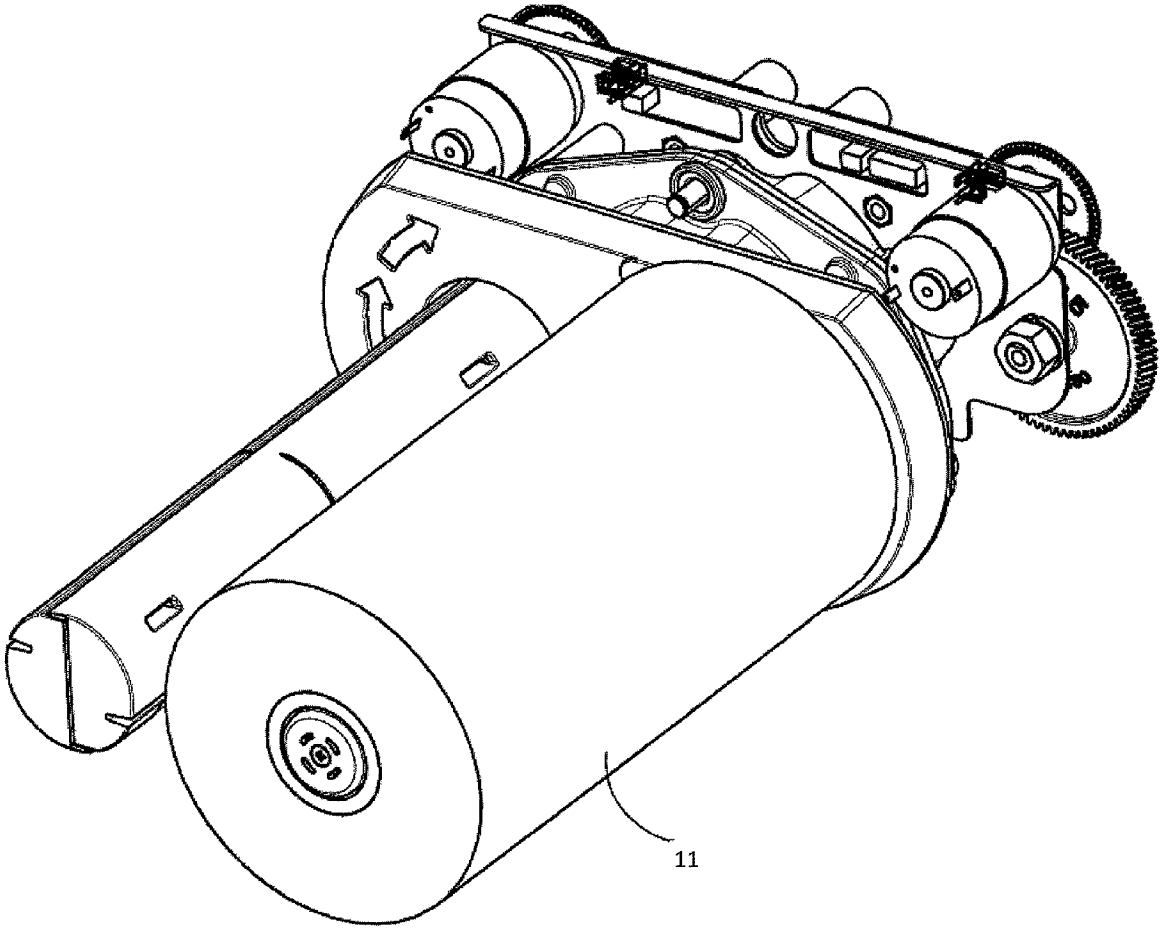
FIG. 21 is a perspective front view of an example ribbon drive assembly with a ribbon supply on the supply spindle that may be used in the execution of an embodiment of the present invention.

Referring now to FIGS. 19-21, a ribbon drive assembly in accordance with example applications is shown. In all example applications, ribbon drive assembly 12 is provided for maintaining a constant tension on ribbon supply 11 as it peels off supply spindle 64 into print station 1 and is metered off onto take up spindle 65.

In example applications, spindles 64, 65 are rotatably connected to base plate 66 at one end and extend through port 67, 68 of cover plate 69 such that their respective distal ends 70, 71 are operative for receiving roll of ribbon supply 11. Each spindle 64, 65 is provided with an independently operated drive system comprising plurality of gears 72, 73 for rotating spindles 64, 65, motor 74, 75 for driving plurality of gears 72, 73 in either a clockwise or counter clockwise direction, and rotary encoder (60 pulses/rev). In example applications, the drive system is connected to base plate 66. In example applications, plurality of gears 72, 73 have a 23:1 gear reduction. It will be understood by those skilled in the art that it is contemplated that motor 74, 75 will be a DC motor however, any type of motor suitable for powering gears 72, 73 and spindles 64, 65 in a rotary movement may be employed. Further, in example applications, motors 74, 75 are independently operated to optimize ribbon tension.

The drive system further comprises circuit board 76 connected to base plate 66 having a control processor for each motor 74, 75 is provided and attached to a side of base plate 66. The electronics of circuit board 76 similarly have two sets of drive components for each spindle 64, 65. In example applications, drive system uses a Cypress PSoC3 which is a 8051 processor core with on-chip programmable digital and analog functions and communication components. However, it will be understood by those skilled in the art that a variety of processors may be used. The processor, motor drive IC's, and opto encoders and associated circuitry are located on single board 16 of the drive system. The bulk of the electrical components such as pulse width modulators, timers, ADC converter and other logic are programmed directly in to the PSoC part using its' system on a chip capabilities. The processor of the drive system is communicatively linked with a main processor of the printer (not shown) PCB via a SPI bus. Firmware updates to the drive system's processor may be made using a boot loader that communicates over an I2C bus.

Having now described the invention, the construction, the operation and use of preferred embodiments thereof, and the advantageous new and useful results obtained thereby, the new and useful constructions, and reasonable mechanical equivalents thereof obvious to those skilled in the art, are set forth in the appended claims.

What is claimed is:

1. A method comprising:

obtaining a media identifier from media loaded into a printer using a sensory system in communication with a control circuit of the printer, the sensory system comprising at least a sensor for measuring a width of media fed along a media feed path;

determining the media type using the media identifier;

retrieving a defined parameter setting from a database of the printer located in a storage medium, the defined parameter setting corresponding to a media type identified by the media identifier;

determining instructions to adjust the at least one system of the printer accordingly to the defined parameter setting retrieved;

sending the instructions to the at least one system of the printer to adjust settings of the printer according to the defined parameter setting;

automatically adjusting the settings of the printer using the defined parameter setting corresponding to the media type identified by the media identifier including print head pressure, ribbon supply tension, ribbon take-up tension, media rewinder tension, hub size, media role size, ribbon motion, a print head element heat setting, an image heat balance setting, print speed, and a torque output of a motor feeding the media along the media feed path according to the instructions; and determining a location of an initial portion of the media fed to a print station of the printer.

2. The method of claim 1, wherein the sensory system comprises a media type sensor.

3. The method of claim 1, wherein the sensory system comprises a media presence sensor; and wherein the control circuit receives an indication from the media presence sensor that the media has been loaded into the printer.

4. The method of claim 3, wherein the sensory system further comprises a media type sensor; and wherein the control circuit requests the media identifier from the media type sensor.

5. The method of claim 1, wherein the sensory system is selected from the group consisting of a barcode reader, a radio frequency identification (RFID) sensor, a laser sensor, a light sensor, a core sensor, an electronic sensor, and an optical sensor.

6. The method of claim 1, wherein the media is a print media.

7. The method of claim 1, wherein the media is a ribbon.

8. The method of claim 1, wherein determining the location of the initial portion of the media fed to the print station of the printer includes providing a signal by a top of form sensor when the initial portion of the media is located at a predetermined location within the print station.

9. A method comprising:

retrieving a media identifier from a menu displayed on an input panel in communication with a control circuit of a printer;

determining the media type using the media identifier;

retrieving a defined parameter setting from a database of the printer located in a storage medium, the defined parameter setting corresponding to a media type identified by the media identifier;

determining instructions to adjust at least one system of the printer accordingly to the defined parameter setting retrieved;

sending the instructions to the at least one system of the printer to adjust settings of the printer according to the defined parameter setting retrieved;

automatically adjusting the settings of the printer using the media type identified by the media identifier including print head pressure, ribbon supply tension, ribbon take-up tension, media rewinder tension, hub size, media role size, ribbon motion, a print head element heat setting, an image heat balance setting, print speed and a torque output of a motor feeding media along the media feed path according to the instructions;

determining a location of an initial portion of the media fed to a print station of the printer.

10. The method of claim 9, wherein the media is a print media.

11. The method of claim 9, wherein the media is a ribbon.

12. A method comprising:

loading media into a printer having a control circuit, a media feed path, and at least one sensor along the media feed path;

transmitting an indication from the at least one sensor to the control circuit that the media has been loaded into a printer, wherein the media has a media identifier;

transmitting a request from the control circuit to the at least one sensor for the media identifier;

sensing, at the at least one sensor, a width of the media fed along the media feed path as the media identifier;

transmitting the media identifier from the at least one sensor to the control circuit;

determining, at the control circuit, the media type using the media identifier;

transmitting a request, from the control circuit to a database, wherein the database has at least one defined parameter setting for at least one system of the printer, wherein the at least one defined parameter setting corresponds to the media type, and wherein the request is for the at least one defined parameter setting corresponding to the media type identified;

determining, at the database, the at least one defined parameter setting corresponding to the media type;

transmitting the at least one defined parameter setting from the database to the control circuit;

determining the instructions necessary to adjust the at least one system of the printer accordingly to the at least one defined parameter setting;

transmitting the instructions to the at least one system of the printer;

automatically adjusting settings of a printer using the media type identified including print head pressure, ribbon supply temperature, ribbon take-up tension, media rewinder tension, hub size, media role size, ribbon motion, a print head element heat setting, an image heat balance setting, print speed and a torque output of a motor feeding the media along the media feed path according to the instructions; and determining a location of an initial portion of the media fed to a print station of the printer.

13. The method of claim 12, wherein the at least one sensor system is selected from the group consisting of a barcode reader, a radio frequency identification (RFID) sensor, a laser sensor, a light sensor, a core sensor, an electronic sensor, and an optical sensor.

14. The method of claim 12, wherein the media is a print media.

15. The method of claim 12, wherein the media is a ribbon.

* * * * *